US010488804B2

(12) United States Patent
Sato

(10) Patent No.: US 10,488,804 B2
(45) Date of Patent: Nov. 26, 2019

(54) MANAGEMENT SYSTEM AND CONTROL METHOD

(71) Applicant: CANON KABUSHIKI KAISHA, Tokyo (JP)

(72) Inventor: Junko Sato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/126,501

(22) Filed: Sep. 10, 2018

(65) Prior Publication Data

US 2019/0094782 A1 Mar. 28, 2019

(30) Foreign Application Priority Data

Sep. 26, 2017 (JP) ..... 2017-185482

(51) Int. Cl.

| | |
|---|---|
| ***G03G 15/00*** | (2006.01) |
| ***B41J 2/175*** | (2006.01) |
| ***G03G 21/18*** | (2006.01) |
| ***G03G 15/08*** | (2006.01) |

(52) U.S. Cl.

CPC ..... *G03G 15/556* (2013.01); *B41J 2/17566* (2013.01); *G03G 15/0863* (2013.01); *G03G 21/1878* (2013.01); *G03G 21/1892* (2013.01); *B41J 2002/17569* (2013.01); *G03G 2215/0697* (2013.01); *G03G 2221/1823* (2013.01)

(58) Field of Classification Search

CPC ..... G03G 15/0863; G03G 15/556; G03G 21/1878; G03G 21/1892; G03G 2215/0697; G03G 2221/1823; B41J 2/17566; B41J 2002/17569

See application file for complete search history.

(56) References Cited

U.S. PATENT DOCUMENTS

| | | | | |
|---|---|---|---|---|
| 6,158,850 | A * | 12/2000 | Cook | B41J 2/17509 347/19 |
| 8,655,200 | B2 | 2/2014 | Kawai | |
| 2002/0113850 | A1* | 8/2002 | Wheeler | B41J 2/17509 347/85 |
| 2008/0112715 | A1* | 5/2008 | Shiroki | G03G 15/553 399/27 |
| 2012/0056920 | A1* | 3/2012 | Asauchi | B41J 2/17513 347/1 |
| 2014/0023382 | A1* | 1/2014 | Kawana | G03G 15/556 399/8 |
| 2016/0219167 | A1* | 7/2016 | Kaneko | H04N 1/00344 |
| 2019/0094750 | A1* | 3/2019 | Kawana | G03G 15/0856 |

FOREIGN PATENT DOCUMENTS

JP 2011197293 A 10/2011

* cited by examiner

*Primary Examiner* — Ryan D Walsh

(74) *Attorney, Agent, or Firm* — Rossi, Kimms & McDowell LLP

(57) ABSTRACT

A management server of the management system receives event information related to the replacement of a toner bottle mounted on a printing apparatus. After receiving event information, if the received event information is an alarm indicating the detection of a failure in a memory tag of the toner bottle, the management server generates a preliminary delivery alarm that provides an instruction to deliver the toner bottle.

11 Claims, 20 Drawing Sheets

FIG. 11A

| Toner bottle replacement history | | | | | | | | |
|---|---|---|---|---|---|---|---|---|
| Device identifier | Alarm reception date and time | Toner replacement date and time | Toner bottle ID | Toner bottle type | Remaining amount (%) | Replacement notice type | Counter | Real use counter |
| Device B | 2016/05/21 13:56 | 2016/05/21 13:56 | TN03-004598 | TONER-1 Y | 100 | Newly mounting | 25000 | 6000 |
| Device A | 2016/06/10 16:32 | 2016/06/10 16:32 | TN01-005323 | TONER-1 C | 100 | Newly mounting | 25000 | 7000 |
| Device B | 2016/08/01 09:22 | 2016/08/01 09:22 | TN03-004601 | TONER-1 Y | 100 | Newly mounting | 34000 | 9000 |
| Device A | 2016/08/19 11:32 | 2016/08/19 11:32 | TN02-002021 | TONER-1 M | 100 | Newly mounting | 32000 | 7000 |
| Device A | 2016/09/10 11:54 | 2016/09/10 11:54 | TN04-006885 | TONER-1 Bk | 70 | Removal when partially used | 33000 | - |
| Device A | 2016/09/10 11:57 | 2016/10/19 11:58 | TN02-002021 | TONER-1 M | 100 | Newly mounting | 33000 | 1000 |
| Device B | 2016/09/10 12:01 | 2016/09/10 12:02 | TN04-006885 | TONER-1 Bk | Unknown | Newly mounting | 42000 | 8000 |

FIG. 11B

| Toner bottle replacement history | | | | | | | | |
|---|---|---|---|---|---|---|---|---|
| Device identifier | Alarm reception date and time | Toner replacement date and time | Toner bottle ID | Toner bottle type | Remaining amount (%) | Replacement notice type | Counter | Real use counter |
| Device B | 2016/05/21 13:56 | 2016/05/21 13:56 | TN03-004598 | TONER-1 Y | 100 | Newly mounting | 25000 | 6000 |
| Device A | 2016/06/10 16:32 | 2016/06/10 16:32 | TN01-005323 | TONER-1 C | 100 | Newly mounting | 25000 | 7000 |
| Device B | 2016/08/01 09:22 | 2016/08/01 09:22 | TN03-004601 | TONER-1 Y | 100 | Newly mounting | 34000 | 9000 |
| Device A | 2016/08/19 11:32 | 2016/08/19 11:32 | TN02-002021 | TONER-1 M | 100 | Newly mounting | 32000 | 7000 |
| Device A | 2016/09/10 11:54 | 2016/09/10 11:54 | TN04-006885 | TONER-1 Bk | 70 | Removal when partially used | 33000 | - |
| Device A | 2016/09/10 11:57 | 2016/10/19 11:58 | TN02-002021 | TONER-1 M | 100 | Newly mounting | 33000 | 1000 |
| Device B | 2016/09/10 12:01 | 2016/09/10 12:02 | TN04-006885 | TONER-1 Bk | 70 | Newly mounting | 42000 | 8000 |

FIG. 20A

| Message ID | Generated date and time | Sales organization name | Customer name | Device identifier | Title | Message | Display start date | Display end date | Icon display setting | Status |
|---|---|---|---|---|---|---|---|---|---|---|
| 00001 | 2016/10/10 13:10 | ABC | ZZZ | DEV12345 | Notice of toner delivery | Consumable below··· | 2016/10/10 | 2016/11/30 | ON | Already read |
| 00002 | 2016/10/11 15:45 | ABC | XXX | DEV12300 | Please confirm | Consumable delivered··· | 2016/10/01 | – | ON | Already read |
| 00003 | 2016/10/11 15:45 | ABC | XXX | DEV12301 | Please confirm | Another printer··· | 2016/10/01 | – | ON | Already read |
| 00004 | 2016/10/13 11:30 | ABC | YYY | DEV11102 | About replacement of tonner··· | Toner in the printer··· | 2016/10/01 | 2016/11/30 | ON | Unread |
| 00005 | 2016/10/17 10:30 | ABC | — | DEV12403 | Notice of toner delivery | Consumable below··· | 2016/10/01 | 2016/11/30 | ON | Unread |
| 00006 | 2016/10/11 15:45 | ABC | AAA | DEV12305 | Notice of visit | Date and time below··· | 2016/10/01 | – | ON | Already read |
| ··· | ··· | ··· | ··· | ··· | ··· | ··· | ··· | ··· | ··· | ··· |

FIG. 20B

| Instruction ID | Generated date and time | Device identifier | Instruction status | Status update date and time |
|---|---|---|---|---|
| 000111 | 2016/10/10 13:10 | DEV12345 | Successful | 2016/10/10 14:05 |
| 000112 | 2016/10/11 15:45 | DEV12300 | Successful | 2016/10/11 16:20 |
| 000113 | 2016/10/11 15:45 | DEV12301 | Successful | 2016/10/11 16:35 |
| 000114 | 2016/10/11 15:45 | DEV12302 | Not transmitted | – |
| 000115 | 2016/10/11 15:45 | DEV12303 | Not transmitted | – |
| ··· | ··· | ··· | ··· | ··· |

MANAGEMENT SYSTEM AND CONTROL METHOD

BACKGROUND OF THE INVENTION

Field of the Invention

The present invention relates to a management system and a control method.

Description of the Related Art

Conventionally, in a printing apparatus of a customer monitored by a management server via a network, there is a service in which the management server automatically delivers consumables for replacement to the printing apparatus if the management server receives a notice indicating that a remaining amount of a specific consumable has reached a predetermined level or less.

Japanese Patent Application Laid-Open No. 2011-197293 discloses a printing apparatus in which a toner cartridge is automatically delivered from the management device by notifying a management device of information about the generation of a near empty region where a remaining toner amount in a toner cartridge will be consumed soon.

The printing apparatus as described above needs to initialize a current value of a remaining toner amount when mounting the toner bottle. In contrast, in performing image formation in the printing apparatus, the remaining toner amount is written in a storage device such as a memory tag provided in the toner bottle. When mounting the tonner bottle, such a printing apparatus reads the remaining toner amount recorded in the memory tag of the mounted toner bottle and initializes the remaining toner amount that has been read to serve as the current value of the remaining toner amount.

However, in the printing apparatus, there are cases in which information cannot be acquired from the memory tag due to reasons, for example, that there is a deviation between a reading position of the sensor that reads the information of the memory tag and a reading position of the memory tag, and a door accessing the toner bottle is not completely closed. Additionally, there are cases in which the printing apparatus does not originally correspond to the toner bottle including a memory tag, or the memory tag is not attached to the toner bottle. For example, there is a toner bottle in which information for identifying the toner bottle is printed with a barcode.

In such a case, it is impossible to acquire the remaining toner amount of the mounted toner bottle, and thereby impossible to initialize the current value of the remaining toner amount. If the current value of the remaining toner amount is not initialized, a deviation may occur between the actual remaining toner amount and the current value managed by the printing apparatus. In this case, the timing at which the printing apparatus transmits a notice indicating that the remaining amount of the consumable has reached a predetermined amount or less based on the current value to the management server is delayed from the actual time, and as a result, the timing for automatically delivering the consumable for replacement is delayed.

SUMMARY OF THE INVENTION

An object of the present invention is to provide a management system that can properly control a remaining amount of a consumable even if information cannot be correctly read from a storage device provided in the consumable.

A management system according to an embodiment of the present invention comprises a receiving unit configured to receive an alarm pertaining to a consumable mounted on a printing apparatus; and an alarm generating unit configured to generate a pseudo alarm for the printing apparatus if the received alarm is an alarm indicating the detection of a failure pertaining to a storage device provided in the consumable, wherein the pseudo alarm provides an instruction to deliver a new consumable for the printing apparatus.

Further features of the present invention will become apparent from the following description of exemplary embodiments (with reference to the attached drawings).

BRIEF DESCRIPTION OF THE DRAWINGS

FIGS. 11A and 11B illustrate an example of a toner bottle replacement history table.

FIGS. 20A and 20B illustrate an example of a table that manages the message.

DESCRIPTION OF THE EMBODIMENTS

Hereinafter, an embodiment for carrying out the present invention will be described with reference to the drawings and the like.

First Embodiment

Figure 1:
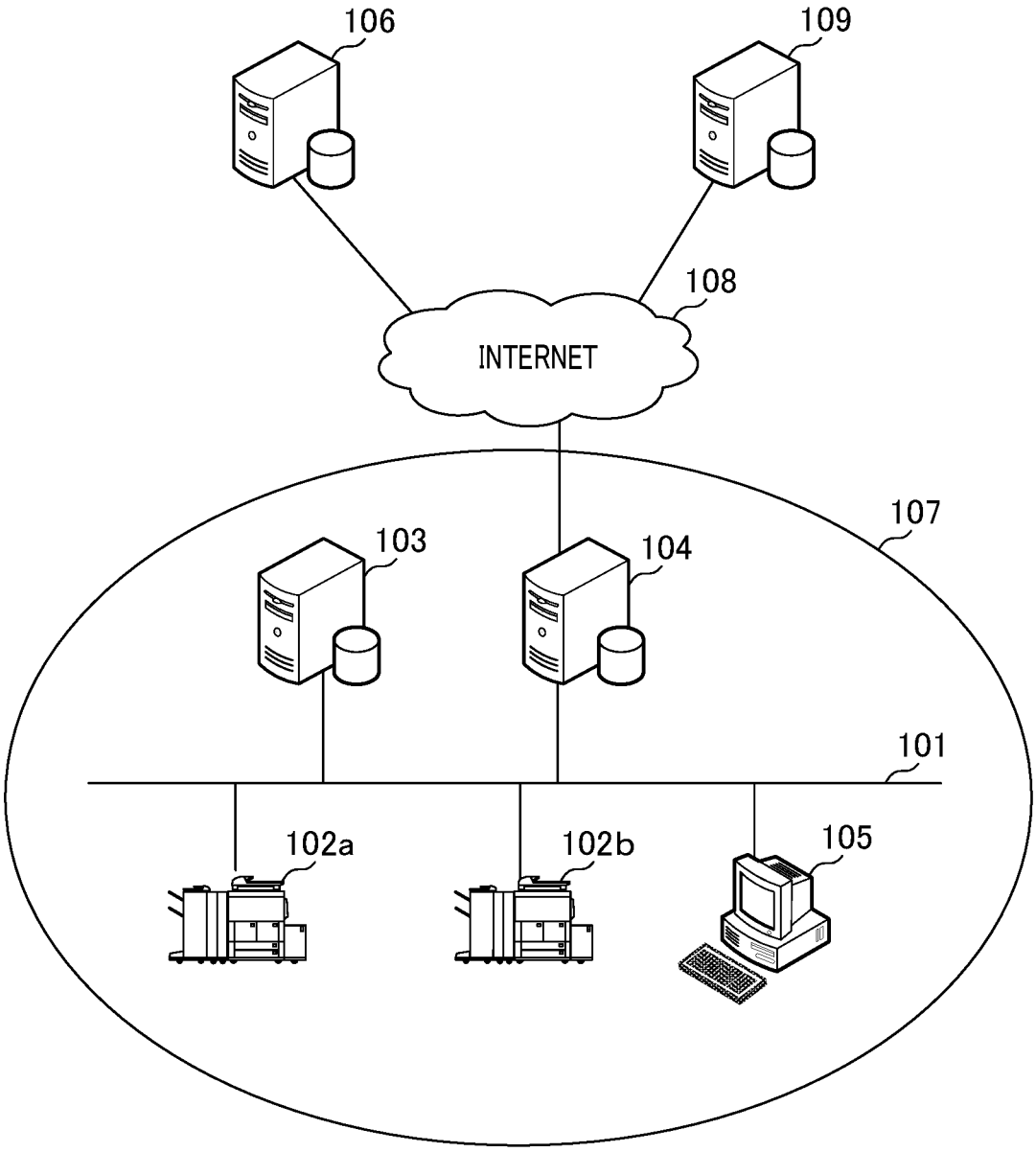
FIG. 1 illustrates an overall configuration example of a management system according to one embodiment of the present invention.

FIG. 1 illustrates an overall configuration example of a management system according to an embodiment of the present invention. In FIG. 1, printing apparatuses 102 (102*a*, 102*b*), a proxy server 103, a firewall 104, and a personal computer (PC) 105 are connected via a LAN 101.

Note that matters shared by the printing apparatuses 102*a* and 102*b* will be described as the printing apparatuses 102. Although FIG. 1 illustrates that two printing apparatuses 102 are connected, where a plurality of printing apparatuses 102 are installed under the environment of the same customer, the present invention is not limited to this, and one or a plurality of printing apparatuses may be used.

Additionally, in the present embodiment, the printing apparatuses 102 are described as serving as apparatuses (image forming apparatuses) that form an image on a sheet with a recording agent such as toner or ink, but the present invention is not limited thereto. For example, the printing apparatuses 102 may be apparatuses that form a three-dimensional object by using a recording agent such as a molding material, referred to as a "3D printer". Additionally, if the printing apparatuses 102 are image forming apparatuses, they may be image forming apparatuses having multiple functions such as FAX and copy.

The proxy server 103 allows a plurality of users to connect the internet 108 using a protocol such as HTTP or HTTPS from an intranet 107. The firewall 104 is installed to enhance the security of the intranet 107. The PC 105 is used by a general user for business and the like, and is configured with hardware resources and software resources, and the OS included in the software resources controls, for example, the execution of an application.

A management server 106 unitarily manages an operation state of the printing apparatuses 102. For example, the management server 106 collects operation information about the printing apparatuses 102 and detects failures in the printing apparatuses 102. Additionally, for example, the management server 106 manages the inventory status at the customer of consumables of the printing apparatuses 102 to be managed, and automatically arranges the delivery of new consumables to the customer as needed. In this context, consumables refer to consumable materials such as toner, ink, paper, molding materials, and replacement parts such as toner bottles, toner cartridges, ink tanks, ink bottles, and ink cartridges.

The intranet 107 corresponds to an environment in which the printing apparatuses 102, the proxy server 103, and the firewall 104 are connected to each other via the LAN 101. Actually, the plurality of intranets 107 and the management servers 106 are connected so as to communicate with each other via the Internet 108. A delivery system 109 is a system constructed by a sales company, and delivers consumables to the customer based on various information provided by, for example, an e-mail from the management server 106.

Figure 2:
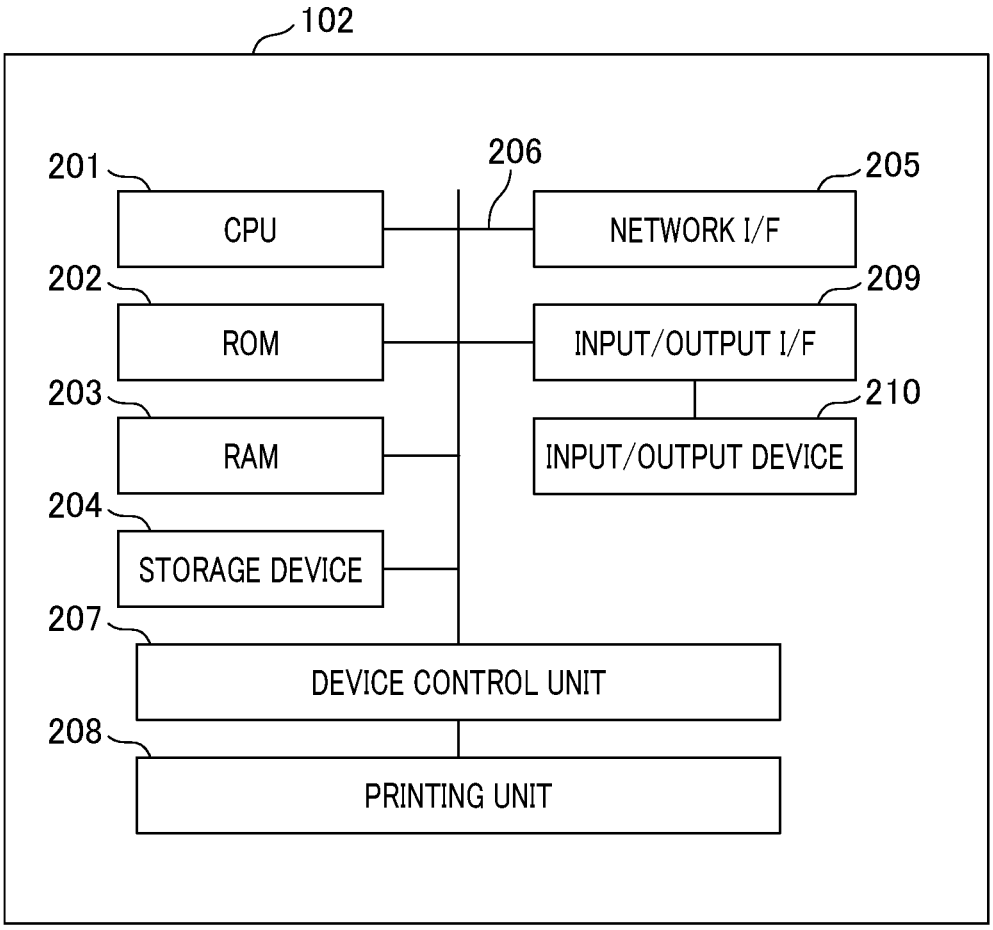
FIG. 2 illustrates an example of a hardware configuration of a printing apparatus.

FIG. 2 illustrates an example of a hardware configuration of the printing apparatuses 102. The printing apparatuses 102 includes, for example, a CPU 201, a ROM 202, a RAM 203, a storage device 204, a network I/F 205, an internal bus 206, a device control unit 207, a printing unit 208, an input/output I/F 209, and an input/output device 210.

The CPU 201 comprehensively controls each device via the internal bus 206. The CPU 201, the ROM 202, the RAM 203, the storage device 204, the network I/F 205, the device control unit 207, the input/output I/F 209, and the like are connected to the internal bus 206. A program is stored in the ROM 202. The program includes a program that performs the processes of the flowcharts in FIGS. 7 to 10 to be described below.

The RAM 203 functions as a memory and a work area of the CPU 201. The CPU 201 performs a process that executes the program together with the ROM 202 and the RAM 203 and performs a process that records image data on a recording medium such as the storage device 204. The storage device 204 functions as an external storage device, can store image data and the like, and additionally, it can store counter information, system information, and various logs in place of the backup RAM 203.

The network I/F 205 exchanges data unidirectionally or bidirectionally with an external network device or a PC via the LAN 101. The device control unit 207 controls the printing unit 208. The printing unit 208 is, for example, an electrophotographic printing unit and includes an exposure unit, a transfer unit, a fixing unit, and the like. The input/output device 210 shows a plurality of configurations that perform inputting and outputting in the printing apparatuses 102.

Specifically, the input/output device 210 accepts an input from a user (for example, by a button input), and transmits a signal corresponding to the input to each of the above-described processing units via the input/output I/F 209. The input/output device 210 also includes a display device (for example, a touch panel) for providing necessary information to the user and accepting user operations. Moreover, a scanning device for reading a document and accepting electronic data as input may also be included in the input/output device 210.

Figure 3:
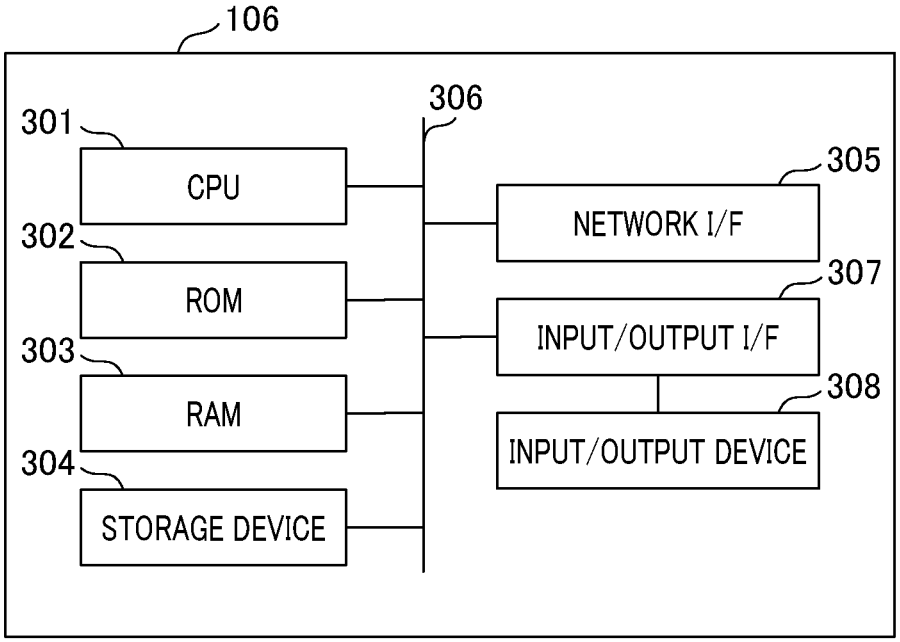
FIG. 3 illustrates an example of a hardware configuration of a management server.

FIG. 3 illustrates an example of a hardware configuration of the management server 106. The management server 106 has, for example, a CPU 301, a ROM 302, a RAM 303, a storage device 304, a network I/F 305, an internal bus 306, an input/output I/F 307, and an input/output device 308.

The CPU 301 comprehensively controls each device via the internal bus 306. The CPU 301, the ROM 302, the RAM 303, the storage device 304, the network I/F 305, the input/output I/F 307, and the like are connected to the internal bus 306. A program is stored in the ROM 302. The program includes a program that realizes the processes of the flowcharts in FIGS. 12 to 15 to be described below.

The RAM 303 functions as a memory and a work area of the CPU 301. The CPU 301 executes the above-described program together with the ROM 302 and the RAM 303. The storage device 304 functions as an external storage device and stores, for example, operation information of the printing apparatuses 102, and in addition, it can store system information and various processing information in place of the backup RAM 303.

The network I/F 305 exchanges data unidirectionally or bidirectionally with an external network device such as the printing apparatuses 102 or the PC via the LAN 101. Through this exchange, the management server 106 can collect various information such as operation information from the printing apparatuses 102.

The input/output device 308 shows a plurality of configurations that perform inputting and outputting in the management server 106. Specifically, the input/output device 308 accepts the input from the user from, for example, a keyboard or a pointing device, and transmits a signal corresponding to the input to each of the above-described processing units using the input/output I/F 307. The input/output device 308 also includes a display device (for example, a CRT and a liquid crystal display) for providing necessary information to the user and accepting user operations.

Figure 4:
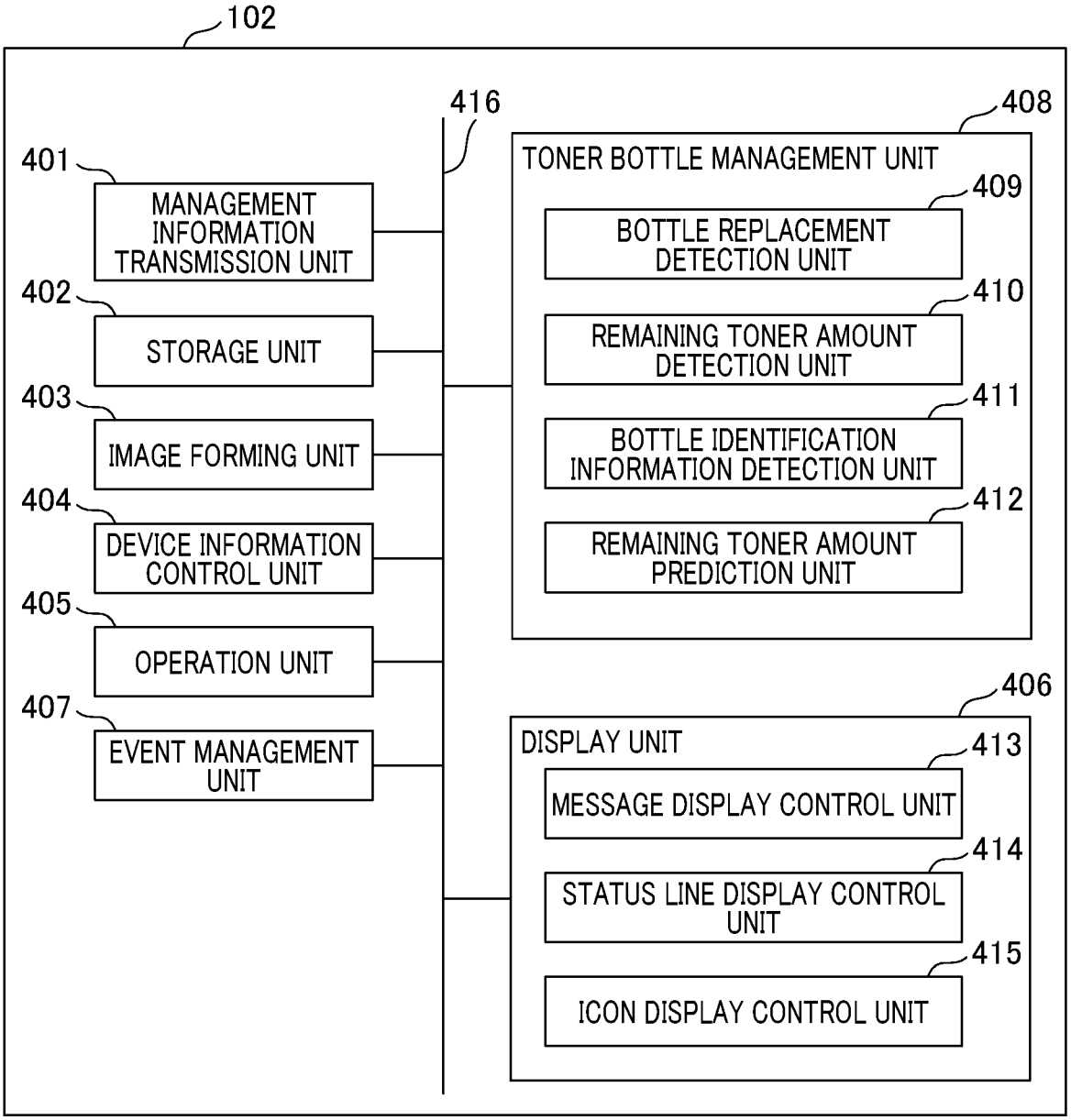
FIG. 4 illustrates an example of a software configuration of the printing apparatus.

FIG. 4 illustrates an example of a software configuration of the printing apparatuses 102. In FIG. 4, the software configuration that executes the control mainly related to the management of the toner bottle is shown, and another configuration is omitted. The printing apparatuses 102 has, for example, a management information transmission unit 401, a storage unit 402, an image forming unit 403, a device information control unit 404, an operation unit 405, a display unit 406, an event management unit 407, and a toner bottle management unit 408.

The management information transmission unit 401 transmits, for example, information about the printing apparatuses 102 (i.e. device information), information about the event generated at the printing apparatuses 102 (i.e. event information), various counter information, information about the consumption level of a consumable to the management server 106. Specifically, the management information transmission unit 401 acquires the above-described various information from the storage unit 402, edits the acquired information into a predetermined format, and transmits the information to the management server 106. The device information includes, for example, identification information for the printing apparatuses 102 (e.g. serial number), network information (e.g. IP address), operation information, and any one of the information is used for, for example, notification as necessary.

The transmission of the event information to the management server 106 starts after a communication test is performed with the management server 106 in a series of installation work in installing the printing apparatuses 102 at the customer location. Additionally, the management information transmission unit 401 receives, for example, various instructions, setting data and other information transmitted from the management server 106. Note that the transmission and reception of the above-described various data are performed by using a protocol such as SMTP or HTTP/HTTPS.

The storage unit 402 performs storage control such as storage and read-out of information in and from the ROM 202, the RAM 203, the storage device 204, and the like. The storage unit 402 stores the history of the identification information of the toner bottle that has been used after the printing apparatuses 102 has been installed at the customer and the identification information of the currently mounted toner bottle. Additionally, the storage unit 402 stores information about the remaining amount of the toner of the toner bottle that is currently mounted (i.e. the current value of the remaining toner amount) and the information about the remaining toner amount when removing the toner bottle, which has previously been mounted and removed.

Additionally, the storage unit 402 manages the event that has been generated when the toner bottle becomes empty or when the tonner bottle is replaced, and the time when the event has been generated and the counter information and the like when the event has been generated, in association with the identification information and the remaining amount information of the tonner bottle. The event includes, for example, an event that is generated when the partially used toner bottle, which will be described below, is removed, and an event that is generated when the toner bottle is mounted.

Additionally, the storage unit 402 stores another piece of the management information that is necessary for the management of the printing apparatuses 102. Specifically, the management information includes, for example, firmware information, device configuration information such as the identification information of the printing apparatuses 102, various counter information, information about consumed level of the consumables, operation history of the printing apparatuses 102, and history information (log data) indicating various abnormal states.

Additionally, the management information includes, for example, the above-described device information and information about the management server 106 (server information). The server information includes information to be used for communicating with the management server 106, such as address information of the management server 106 that manages the printing apparatuses 102. The storage unit 402 records the above-described various information in, for example, the ROM 202, the RAM 203, and the storage device 204.

The image forming unit 403 generates and outputs print data to be transmitted to the printing unit 208. The device information control unit 404 performs print control and management of an abnormal state of the printing apparatuses 102 and also manages counter information and manages notice information. The counter information is, for example, information indicating a value obtained by counting the number of printed sheets printed by the printing apparatuses 102 with a sensor and the like and a consumed level of the consumables.

Additionally, the device information control unit 404 periodically inquires the management server 106 about whether or not there is an instruction to the local-apparatus (the printing apparatuses 102), and if there is an instruction, the device information control unit 404 executes the instruction and notifies the management server 106 about the result. The device information control unit 404 provides an instruction to each processing unit depending on the contents of the instruction and notifies the management server 106 about the executed result at each processing unit.

The operation unit 405 is an interface that enables operation instructions to the printing apparatuses 102. The operation instruction are, for example, a print instruction and the like. The display unit 406 makes the input/output device 210 display a UI screens such as status information of the printing apparatuses 102, information about consumed levels of various consumables including a remaining amount information of the toner bottle and setting information. The display unit 406 is configured by a message display control unit 413, a status line display control unit 414, and an icon display control unit 415.

The message display control unit 413 activates a browser function such as a Web browser in accordance with a user's operation and controls the display of a message and the like in accordance with an instruction from the management server 106. The status line display control unit 414 controls the display of the status line on the UI screen. For example, the status line display control unit 414 controls the display of a status line 1602 in FIG. 16A, to be described below. The contents displayed on the status line 1602 are, for example, status information of the printing apparatuses 102, and a notice indicating the reception of a message from the management server 106. The icon display control unit 415 controls the display of various icons on the UI screen.

The event management unit 407 manages event information upon receipt of the generation of event in the printing apparatuses 102. The event information managed by the event management unit 407 includes, for example, a print job issued by a user of the printing apparatuses 102, an error (fault), and the status information of the printing apparatuses 102. For example, the error of the printing apparatuses 102 include urgent errors such as hard disk errors and accounting counter errors, and errors with warning level such as paper jam or toner low. Additionally, the event management unit 407 is notified via a device interface 416 about event information in connection with an event generated due to the replacement of the toner bottle.

The toner bottle management unit 408 manages mounting and removing of the toner bottle, and the information about a remaining amount of the toner in the printing apparatuses 102. The toner bottle management unit 408 is configured by a bottle replacement detection unit 409, a remaining toner amount detection unit 410, a bottle identification information detection unit 411, and a remaining toner amount prediction unit 412.

Upon detection of the replacement of the toner bottle in the printing apparatuses 102, the bottle replacement detection unit 409 notifies the event management unit 407 about information indicating the start and completion of the replacement of the toner bottle via the device interface 416. Specifically, if detecting that the toner bottle has been removed in the printing apparatuses 102, the bottle replacement detection unit 409 reports the identification information for the removed toner bottle and the information indicating that the toner bottle has been removed. Additionally, if detecting that the toner bottle has been mounted onto the printing apparatuses 102, the bottle replacement detection unit 409 reports the information indicating that the toner bottle has been mounted.

If the toner bottle has been mounted, the remaining toner amount detection unit 410 acquires the remaining toner amount information in the toner bottle from a storage device such as a memory tag and the like provided in the toner bottle, and transmits the information to the remaining toner amount prediction unit 412 to serve as the initial value of the remaining tonner amount. Additionally, if the remaining toner amount information cannot be acquired from the toner bottle, the remaining toner amount detection unit 410 acquires the initial value of the remaining toner amount from the management server 106 via the device information control unit 404.

The bottle identification information detection unit 411 acquires the identification information about the toner bottle from the storage device such as a memory tag of the toner bottle. For example, if the toner bottle is mounted onto the printing apparatuses 102, the bottle identification information detection unit 411 acquires the identification information of the toner bottle. Additionally, the bottle identification information detection unit 411 transmits the acquired identification information of the toner bottle to the storage unit 402 via the device interface 416 for managing it. Additionally, the bottle identification information detection unit 411 transmits the acquired identification information of the toner bottle to the event management unit 407 via the device interface 416.

When the toner is used by the printing process performed by the printer 102, the remaining toner amount prediction unit 412 calculates (predicts) the amount of usage of the toner used in the printing process. Subsequently, the remaining toner amount prediction unit 412 acquires the remaining toner amount information at this time from the storage unit 402. The remaining toner amount prediction unit 412 obtains the latest remaining toner amount information by subtracting the calculated use amount of the toner from the acquired remaining toner amount information.

The remaining toner amount prediction unit 412 transmits the calculated latest remaining toner amount information to the storage unit 402 to update the remaining toner amount information (i.e. the current value of the remaining toner amount) stored in the storage unit 402. Additionally, the remaining toner amount prediction unit 412 writes the calculated latest remaining toner amount information as remaining toner amount information stored in a storage device such as a memory tag and the like of the toner bottle. As described above, when the toner is used in the printing apparatuses 102, the remaining toner amount information is calculated each time, and the calculated latest remaining toner amount information is stored in the storage unit 402 and the storage device of the toner bottle.

Additionally, the remaining toner amount prediction unit 412 transmits the calculated latest remaining toner amount information to the message display control unit 413 via the device interface 416. The message display control unit 413 makes the input/output device 210 displays the received latest remaining toner amount information. Additionally, if the calculated toner amount information reaches a predetermined value or less, the remaining toner amount prediction unit 412 notifies the event management unit 407 about this. Upon receipt of the notice, the event management unit 407 notifies the management server 106 about the generation of an event indicating that the remaining toner amount has reached a predetermined amount or less (toner low).

Figure 5:
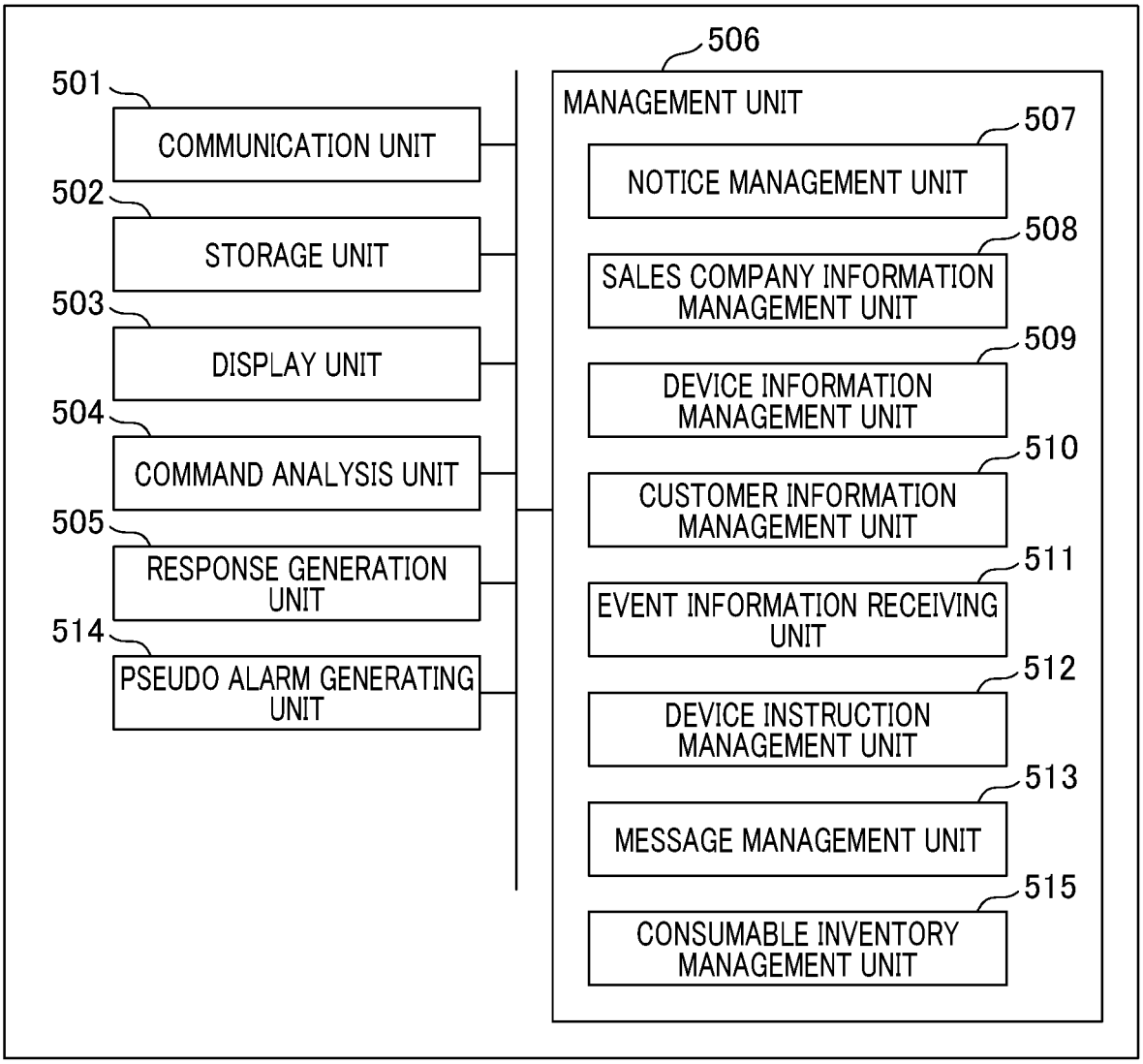
FIG. 5 illustrates an example of a software configuration of the management server.

FIG. 5 illustrates an example of a software configuration of the management server 106. The management server 106 includes a communication unit 501, a storage unit 502, a display unit 503, a command analysis unit 504, a response generation unit 505, a management unit 506, and a pseudo alarm generating unit 514. The communication unit 501 communicates with the printing apparatuses 102.

Specifically, the communication unit 501 receives device information transmitted from the printing apparatuses 102 and the event information such as an event generated in the printing apparatuses 102, for example, a toner bottle replacement event. Additionally, the communication unit 501 transmits an instruction of communication schedule, various setting information, information necessary for maintenance, and the like to the printing apparatuses 102.

The storage unit 502 performs storage control such as storage and readout of information in and from, for example, the ROM 302, the RAM 303, and the storage device 304. The storage unit 502 stores, for example, device information, sales company information, and customer information. The display unit 503 makes the input/output device 308 displays device information such as status information and setting information of the printing apparatuses 102 stored in the storage unit 502 as a Web screen. In the management server 106, a WWW server program is running, so that a service person and the like of the sales company can browse various information described above by using the Web browser on the PC. Hereinafter, the Web screen provided by the management server 106 is referred to as a "portal site".

The command analysis unit 504 analyzes a request (i.e. command) transmitted from the printing apparatuses 102, and applies the analysis result in the storage unit 502, the display unit 503, and the management unit 506. The response generation unit 505 generates a response to the printing apparatuses 102 for the command analyzed by the command analysis unit 504.

The management unit 506 manages information necessary for monitoring and maintaining the printing apparatuses 102. The management unit 506 is configured by a notice management unit 507, a sales company information management unit 508, a device information management unit 509, a customer information management unit 510, an event information receiving unit 511, a device instruction management unit 512, a message management unit 513, and a consumable inventory management 515.

The notice management unit 507 designates notice content and a notice destination, and generates notice information. The notice includes, for example, a notice of a maintenance request to a system that makes arrangements for a service person who maintains the printing apparatuses 102 (not illustrated) and a replenishment request notice for consumables. The sales company information management unit 508 manages information of a sales company that manages and maintains (or supports) the printing apparatuses 102 installed in the customer environment.

The device information management unit 509 manages the device information of the printing apparatuses 102 that are to be maintained. The information to be managed by the device information management unit 509 is, for example, the identification information of the printing apparatuses 102, state information such as abnormality, maintenance history, information about the administrator of the printing apparatuses 102, and consumables management information of the printing apparatuses 102. The customer information management unit 510 manages the information of the customer who installs the printing apparatuses 102. The customer information includes the identification information of the printing apparatuses 102 used by the customer and the information related to the maintenance contracts between the customer and the sales company.

The event information receiving unit 511 receives the event information generated by the printing apparatuses 102 via the communication unit 501. The event information received by the event information receiving unit 511 is event information of, for example, a toner bottle replacement event and an event indicating that the remaining toner amount of the toner bottle has reached a predetermined amount or less (toner low).

In the present embodiment, the event information transmitted to the management server 106 as an event related to toner bottle replacement includes "an alarm informing about the mounting of a new toner bottle" or "an alarm informing about the removal of the partially used toner bottle". Additionally, another piece of the event information transmitted to the management server 106 as an event related to the replacement of the toner bottle includes an "alarm informing about the delivery of a toner bottle in advance" indicating that the remaining toner amount in the toner bottle has reached the predetermined amount or less. Note that, in the present embodiment, the alarm from the printing apparatuses 102 is defined as an event to be notified or recorded, not the failure of the printing apparatuses 102.

The event information receiving unit 511 stores the received event information in the device information management unit 509. Upon receipt of the alarm informing about the delivery of a toner bottle in advance, the event information receiving unit 511 makes a message requesting automatic delivery of a new toner bottle, and transmits the message to the delivery system 109 of the sales company via the communication unit 501. That is, the event information receiving unit 511 instructs the delivery system 109 to deliver a new toner bottle.

As a result, a new toner bottle is automatically delivered to the customer before the time for replacement of the toner bottle comes. Accordingly, the customer himself/herself can omit the work of monitoring the remaining toner amount information and the like displayed on the display device and the like of the printing apparatuses 102 and ordering a new toner bottle at an appropriate timing.

Additionally, the event information receiving unit 511 receives an acquisition request for various information related to the management server 106 from the printing apparatuses 102. Upon receipt of the acquisition request, the event information receiving unit 511 generates a response including information that is necessary for the printing apparatuses 102 with using the response generation unit 505, and transmits the response to the printing apparatuses 102 via the communication unit 501. The acquisition request for the information from the printing apparatuses 102 includes, for example, an acquisition request of an initial value of the remaining toner amount to be described below.

The device instruction management unit 512 manages instructions to the printing apparatuses 102. The instruction managed by the device instruction management unit 512 is, for example, an instruction to change the information transmission schedule to the management server 106, or an instruction to make the display unit 406 of the printing apparatuses 102 display a message. Note that instructions to the printing apparatuses 102 include an instruction registered from a user of the sales company or the delivery system 109 via the portal site provided by the management server 106 or the dedicated I/F, and an instruction generated by the management server 106.

Both instructions are stored in the storage unit 502 of the management server 106 as instructions to the printing apparatuses 102. Additionally, the device instruction management unit 512 manages the result for executing some processing upon receipt of the instruction by the printing apparatuses 102 as a status such as "success", "failure", and "unknown". The message management unit 513 generates and manages a message displayed by the display unit 406 of the printing apparatuses 102 upon receipt of the instruction from the management server 106.

Upon receipt of the registration of a message to be displayed on the printing apparatuses 102 from a portal site and the like provided by the management server 106, the message management unit 513 generates a message in HTML format. Then, the message management unit 513 manages the list of the generated message for the printing apparatuses 102 by using a message management table as shown in FIG. 20A to be described below. The message managed by the message management unit 513 relates to general maintenance of the printing apparatuses 102 such as the delivery status of consumables, a dispatch status of a service person, a notice about executing system maintenance, or a notice executing firmware update.

The consumable inventory management 515 manages the inventory quantity of the consumables that can be used by the customer, for example, parts such as toner bottles and fixing devices that are provided in the printing apparatus 102 and can be replaced, and toner recycling boxes, to serve as inventory information, in association with customer information. If, in the management server 106, the consumable inventory management 515 receives a notice indicating that the customer has replaced the consumable and used a new consumable from the inventory from the printing apparatuses 102, the consumable inventory management 515 updates the inventory information of the corresponding customer, that is, subtracts the inventory quantity.

Additionally, if the inventory quantity of the consumable that can be used by the customer decreases, the consumable inventory management 515 makes a message that requests automatic delivery and instructs sales companies or the like via the communication unit 501 to deliver the consumable. The pseudo alarm generating unit 514 generates event information that is normally generated by the printing apparatuses 102 and notified to the management server 106 is notified about this in a pseudo manner.

For example, if it is determined that the delivery of a spare toner bottle to a customer is necessary, the event information that substitutes for the advance delivery alarm informing about the advanced delivery of a toner bottle generated by the printing apparatuses 102 is generated in a pseudo manner upon receipt of the instruction from the event information receiving unit 511. Accordingly, an alarm for providing an instruction of the delivery of the consumables can be generated in a pseudo manner without an event notice from the printing apparatuses 102. Note that the details of the processes related to the pseudo alarm will be described below with reference to FIG. 12 and FIG. 14.

Figure 6:
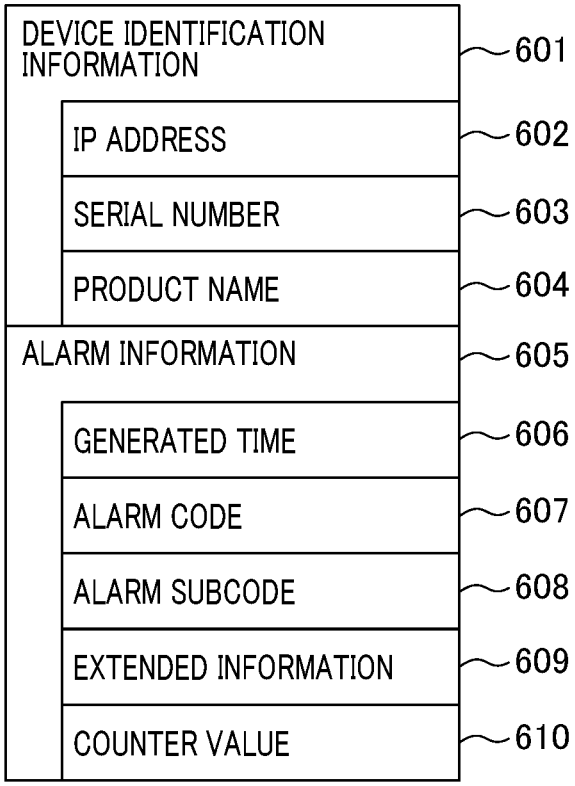
FIG. 6 illustrates an example of a data structure of event information.

FIG. 6 illustrates an example of a data structure of the event information received from the printing apparatuses 102 by the management server 106. Note that, in FIG. 6, the event information that the management server 106 is notified responding to the generation of a toner bottle replacement event in the printing apparatuses 102 will be described as an example, and another piece of event information is similar.

The event information is generated when various events are generated in the printing apparatuses 102 and is transmitted to the management server 106. The event information is described, for example, in XML format and transmitted to the management server 106 by using an encryption protocol such as HTTPS. However, the format of the event information and the communication protocol for transmission are not limited thereto.

The event information indicating that the toner bottle replacement event, specifically, the event indicating the mounting of the toner bottle or the removal of the partially used tonner bottle is notified to the management server 106 as an alarm from the printing apparatuses 102. As described above, in the present embodiment, the alarm from the printing apparatuses 102 is defined as an event to be notified or recorded, not the failure of the printing apparatuses 102. The alarm of the printing apparatuses 102 is not limited to the toner bottle replacement event, but also includes events such as "paper out" and "staple out".

These events are managed by the code in the management server 106, and there is a code corresponding to each event. In the event information, these codes are included as an alarm code 607 and an alarm subcode 608 to be described below. Each item included in the event information will be described below.

As shown in FIG. 6, the event information is configured by device identification information 601 and alarm information 605. The device identification information 601 is information for identifying the printing apparatuses 102, and in the present embodiment, it includes information such as an IP address 602, a serial number 603, and a product name 604. The alarm information 605 is information indicating the contents of the event generated in the printing apparatuses 102, and includes generated time 606, the alarm code 607, the alarm subcode 608, extended information 609, and a counter value 610.

The generated time 606 indicates the time at which the event has been generated. For example, in the case of a toner bottle mounting event, the time at which the bottle replacement detection unit 409 has detected the mounting of the toner bottle is recorded. The alarm code 607 is a code corresponding to each of the above-described events, and is information obtained by coding information indicating the contents of the event generated in the printing apparatuses 102. In the present embodiment, it is specified by the alarm code 607 that the event generated in the printing apparatuses 102 is an event related to the toner bottle, such as the mounting of the toner bottle or the removal of the partially used toner bottle.

The alarm subcode 608 is obtained by coding information indicating the details of the contents of the event. For example, in the case of the event information related to the toner bottle, the alarm subcode 608 indicates color information of the toner of the toner bottle that is the subject of the event. The extended information 609 records information unique to an event that cannot be represented only by the alarm code 607 and the alarm subcode 608.

For example, in the case of the event information related to the toner bottle, for example, the identification information of the mounted toner bottle (toner bottle ID) and the information about a remaining toner amount of the toner bottle at the time when the event has been generated are recorded. The counter value 610 records a total counter value counted by the printing apparatuses 102 at the time when the event has generated.

Figure 7:
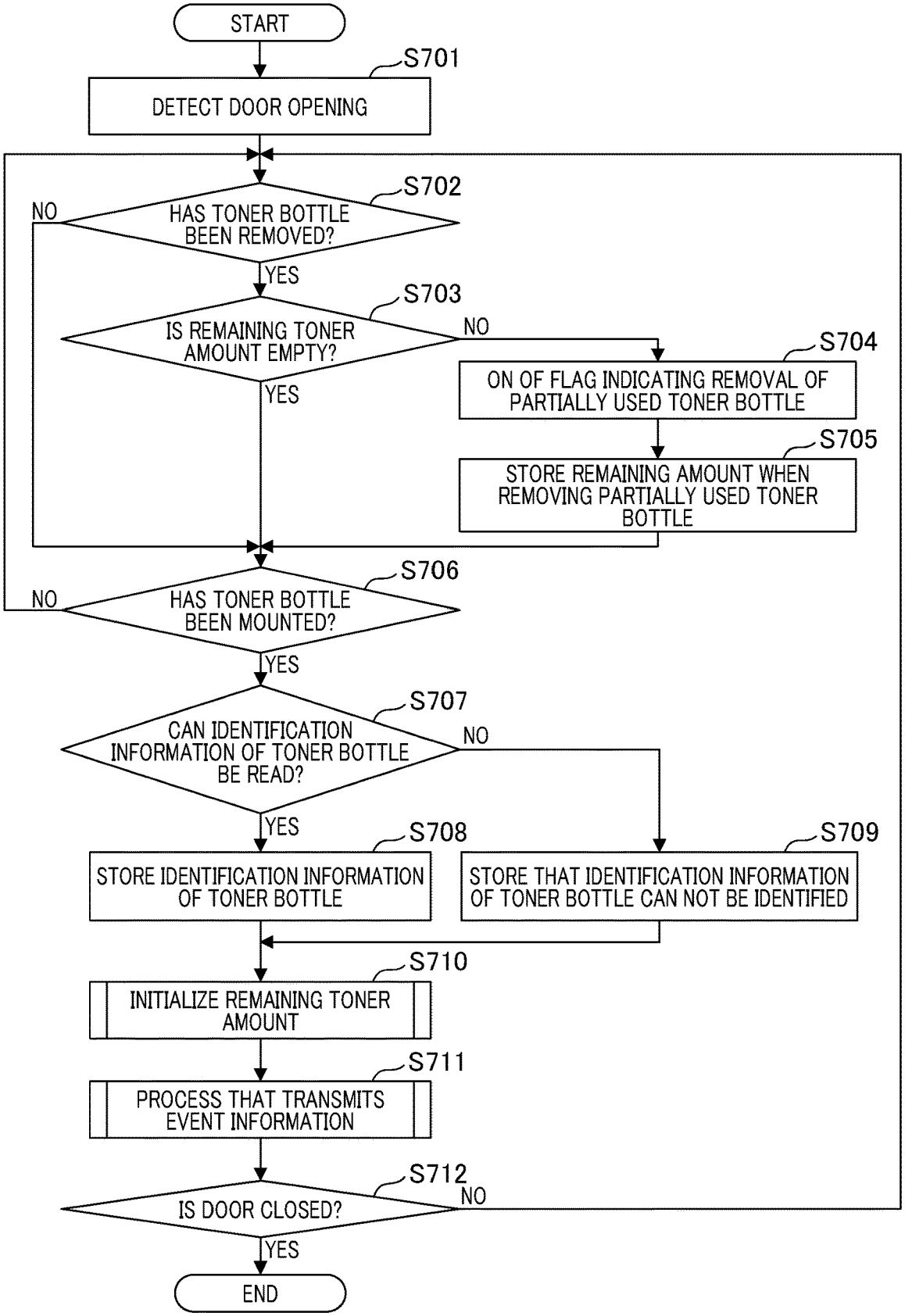
FIG. 7 illustrates a process until the management server has been notified about the replacement of the toner bottle.

FIG. 7 is a flowchart for explaining the process from the replacement of the toner bottle in the printing apparatuses 102 to the notification thereof to the management server. In detail, the process in FIG. 7 starts by the opening of the door by which the toner bottle is accessed by the user, in the printing apparatuses 102. In FIG. 7, the printing apparatuses 102 initializes the current value of the remaining toner amount and transmits the event information related to the toner bottle to the management server 106.

The process in FIG. 7 is realized by executing a program stored in any one of the ROM 202, the RAM 203, and the storage device 204 by the CPU 201. In step S701, the bottle replacement detection unit 409 of the printing apparatuses 102 detects that the user has opened the door of the printing apparatuses 102 (door open). In step S702, the bottle replacement detection unit 409 determines whether or not the toner bottle has been removed.

If it is determined that the toner bottle has been removed, the process proceeds to step S703, and if it is determined that the toner bottle has not been removed, the process proceeds to step S706. In step S703, the event management unit 407 acquires a current value of the remaining toner amount managed by the storage unit 402, and determines whether or not there is no remaining toner amount. If the event management unit 407 determines that there is no remaining toner amount, the process proceeds to step S706. If the event management unit 407 determines that there is no remaining toner amount, it is determined that the partially used toner bottle has been removed, and the process proceeds to step S704.

In step S704, the event management unit 407 stores a flag indicating the removal of the partially used tonner bottle in association with the information of the removed toner bottle to the storage unit 402. In step S705, the event management unit 407 stores the current value of the remaining toner amount, in other words, the remaining toner amount at the removal of the partially used tonner bottle in the storage unit 402, in association with the information of the removed toner bottle.

In step S706, the bottle replacement detection unit 409 determines whether or not the toner bottle has been mounted. If the bottle replacement detection unit 409 determines that the toner bottle has been mounted, the process proceeds to step S707. If the bottle replacement detection unit 409 determines that the toner bottle has not been mounted, the process returns to step S702. In step S707, the bottle identification information detection unit 411 determines whether or not the identification information of the newly mounted toner bottle can be read.

The identification information of the toner bottle is added to the toner bottle by using, for example, a memory tag and a barcode, and can be read by a sensor (not illustrated) provided in the printing apparatuses 102. However, since there is a case in which the identification information of the toner bottle cannot be read well due to a deviation between the sensor of the printing apparatuses 102 and the reading position of the toner bottle, contamination of the barcode, the failure in the memory tag, and the like, in step S707, the determination whether or not the identification information can be read is performed.

If it is determined that the identification information of the toner bottle can be read, the process proceeds to step S708. In step S708, the bottle identification information detection unit 411 reads the identification information of the toner bottle and stores the identification information in the storage unit 402. In contrast, if it is determined in step S707 that the identification information of the toner bottle cannot be read, the process proceeds to step S709.

In step S709, the information indicating that the identification information of the toner bottle cannot be identified is stored in the storage unit 402. In step S710, the remaining toner amount prediction unit 412 initializes the remaining toner amount and updates the current value of the remaining toner amount. Note that the details of the initialization process of the remaining toner amount will be described below with reference to FIG. 8.

In step S711, the management information transmission unit 401 performs a process of transmitting the event information related to the replacement of the toner bottle. Note that the details of the process of transmitting the event information related to the replacement of the toner bottle will be described below with reference to FIG. 9. In step S712, the bottle replacement detection unit 409 determines whether or not the door of the printing apparatuses 102 is closed, and if it is determined that the door is closed (door closing), the process in FIG. 7 ends.

In contrast, if it is impossible to detect that the door has been closed, the process returns to step S702 and the determination whether or not another toner bottle has been removed or mounted is continued. Note that in step S702, if the removal of the toner bottle has not been performed, the process proceeds to step S706 to determine whether or not the toner bottle has been mounted. As a result, a process of initializing a remaining toner amount and the transmission of event information related to the replacement of the toner bottle are performed for the toner bottle that has been first mounted when installing the printing apparatuses 102.

Figure 8:
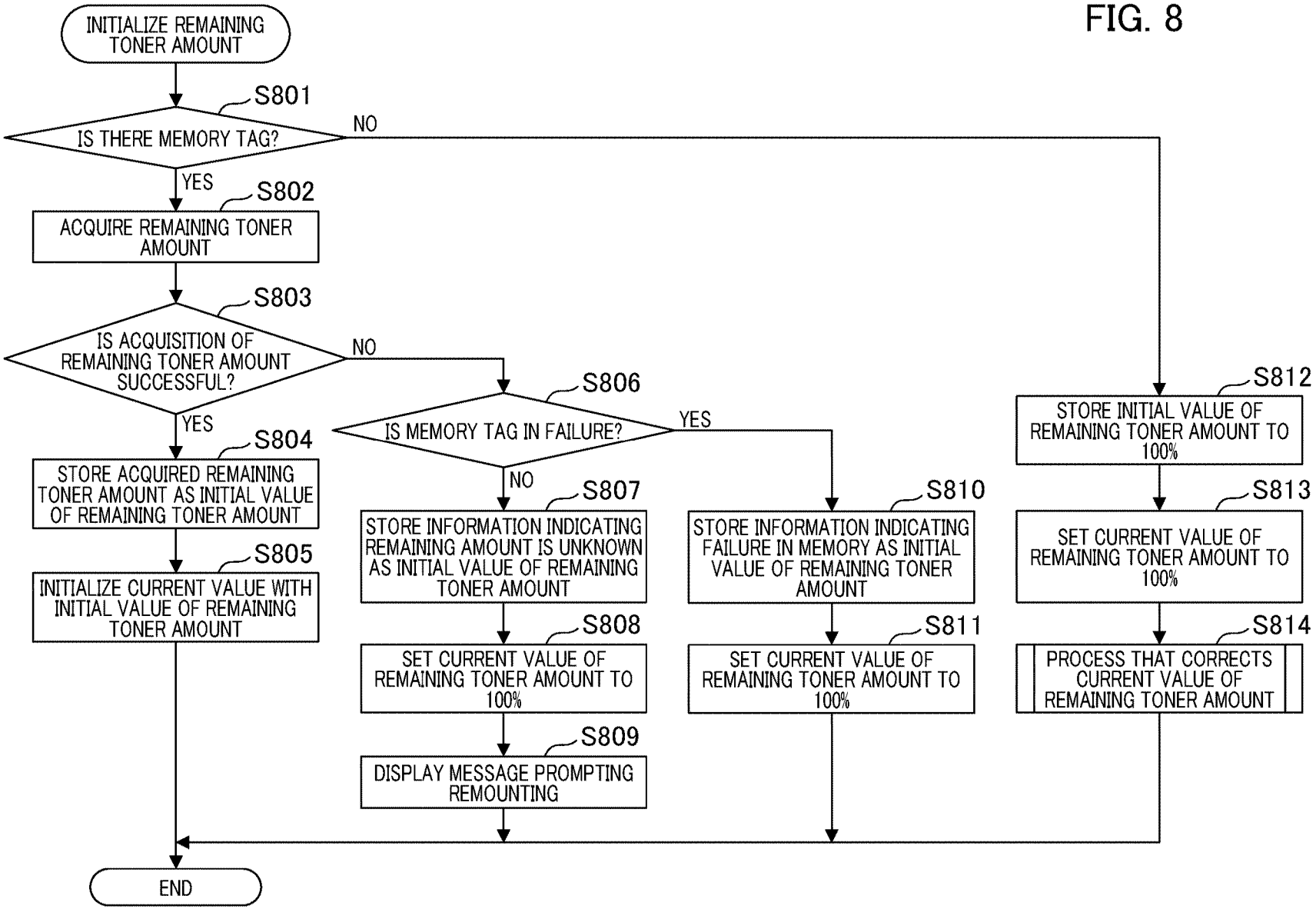
FIG. 8 illustrates an initialization process of a remaining toner amount.

FIG. 8 is a flowchart that explains the details of the initialization process of the remaining toner amount (S710). In step S801, the remaining toner amount detection unit 410 determines whether or not the toner bottle mounted in step S706 has a memory tag.

If it is determined that the toner bottle has a memory tag, the process proceeds to step S802, and if it is determined that the toner bottle does not have a memory tag, the process proceeds to step S812. For example, if a barcode is added to the toner bottle, it is determined that the tonner bottle does not have the memory tag in step S801.

In step S802, the remaining toner amount detection unit 410 acquires the information about the remaining toner amount of the toner bottle from the memory tag. The remaining toner amount information includes at least the remaining toner amount. In step S803, the remaining toner amount detection unit 410 determines whether or not the acquisition of the remaining toner amount information has been successful. If it is determined that the acquisition of the information about the remaining toner amount has been successful, the process proceeds to step S804, and if it is determined that the acquisition of the information about the remaining toner amount information has failed, the process proceeds to step S806.

In step S804, the remaining toner amount prediction unit 412 stores the remaining toner amount acquired from the memory tag in the storage unit 402 as an initial value of the remaining toner amount. Additionally, in step S805, the remaining toner amount prediction unit 412 initializes the current value of the remaining toner amount managed by the storage unit 402 with the initial value of the remaining toner amount.

In contrast, if it is determined in step S803 that the acquisition of the information about the remaining toner amount has failed, the remaining toner amount detection unit 410 determines, in step S806, whether or not the memory tag has failed. Specifically, if the information cannot be acquired despite the fact that the toner bottle is mounted at an appropriate position and no deviation and the like has occurred at the position read by the sensor of the printing apparatuses 102, the remaining toner amount detection unit 410 detects failure of the memory tag and determines that the memory tag has failed.

If the remaining toner amount detection unit 410 determines that the memory tag has not failed, the process proceeds to step S807, and if it determines that the memory tag has failed, the process proceeds to step S810. In step S807, the remaining toner amount prediction unit 412 stores the information indicating that the remaining amount serving as the initial value of the remaining toner amount is unknown in the storage unit 402.

In step S808, the remaining toner amount prediction unit 412 initializes the current value of the remaining toner amount managed by the storage unit 402 with a predetermined value, for example, 100%. In step S809, the remaining toner amount prediction unit 412 displays a message urging the user to mount the toner bottle again on the display unit 406 via the message display control unit 413. On the display unit 406, for example, a message such as "please mount the toner bottle again" is displayed.

In contrast, if it is determined in step S806 that the memory tag has failed, in step S810, the remaining toner amount prediction unit 412 stores information indicating that the memory tag has failed in the storage unit 402 as the initial value of the remaining toner amount. In step S811, the remaining toner amount prediction unit 412 initializes the current value of the remaining toner amount managed by the storage unit 402 with a predetermined value, for example, 100%.

In step S812, the remaining toner amount prediction unit 412 stores a predetermined value, for example, 100%, as the initial value of the remaining toner amount, in the storage unit 402. In step S813, the remaining toner amount prediction unit 412 initializes the current value of the remaining toner amount managed by the storage unit 402 with a predetermined value, for example, 100%. In step S814, the remaining toner amount prediction unit 412 performs a process that corrects a current value of the remaining toner amount initialized in step S813. Note that the details of the process that corrects the current value of the remaining toner amount will be described below with reference to FIG. 10.

Figure 9:
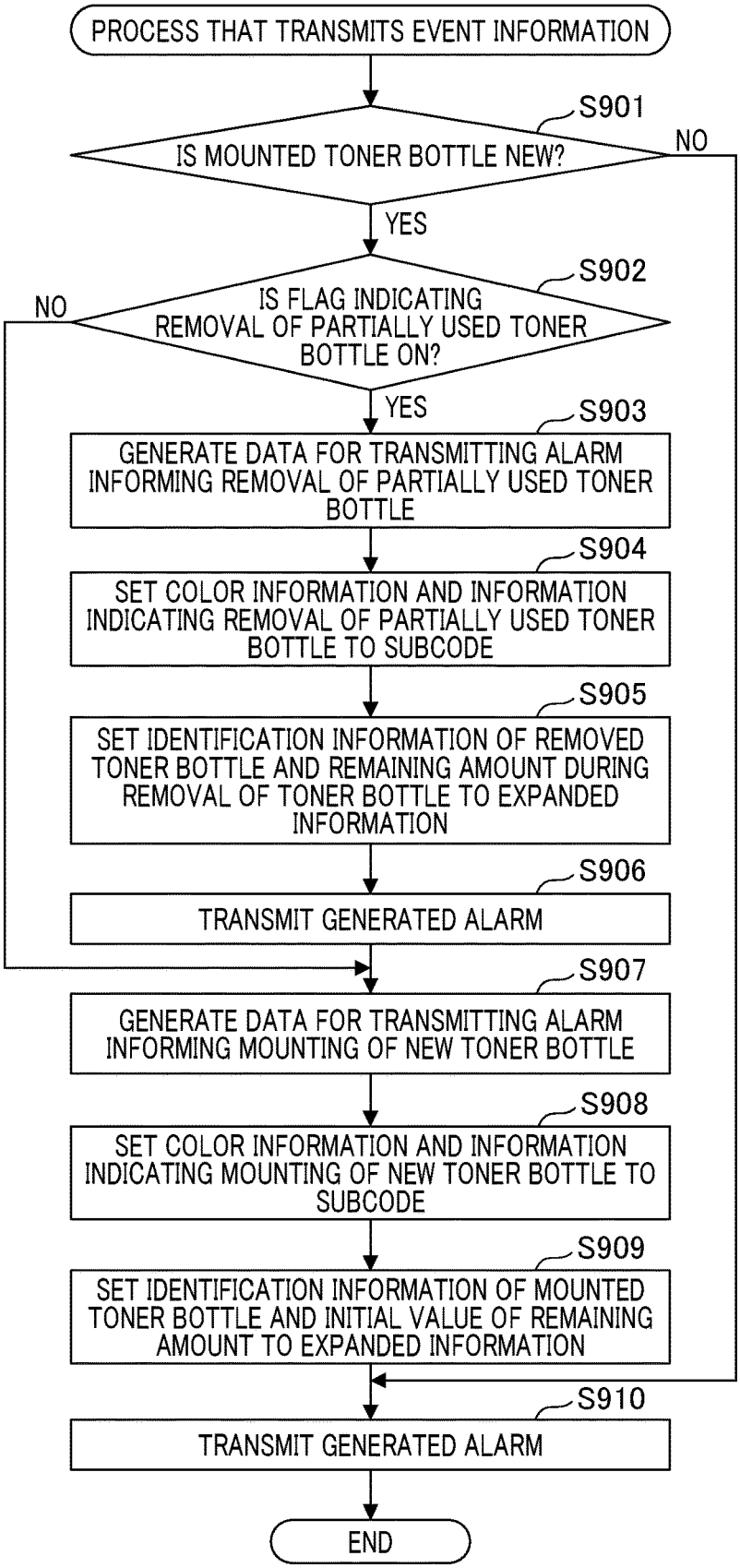
FIG. 9 illustrates a process of transmitting the event information.

FIG. 9 is a flowchart illustrating the details of the process of transmitting event information related to the replacement of the toner bottle (S711). In the present embodiment, as event information related to the replacement of the toner bottle, there are an alarm informing about the mounting of a new toner bottle and an alarm informing about the removal of the partially used toner bottle.

In step S901, the management information transmission unit 401 determines whether the toner bottle mounted in step S706 is a toner bottle that has already been managed in the storage unit 402 or a new toner bottle. Specifically, the management information transmission unit 401 determines whether or not the identification information of the mounted toner bottle has been stored in the storage unit 402. If it is determined that the mounted toner bottle has already been managed, the process ends. Note that if only the removal of the toner bottle has been performed and no toner bottle that has been newly mounted has found, the processes from steps S902 to S906 are performed as shown in FIG. 9.

In contrast, if the mounted toner bottle is determined to be a new toner bottle that has not been managed by the storage unit 402, the process proceeds to step S902. In step S902, the management information transmission unit 401 determines whether or not the toner bottle that has been removed in step S702 has been removed before the tonner of the toner bottle is completely consumed, in other words, before the remaining toner amount reaches 0%. Whether or not the toner bottle has been removed before the remaining toner amount reaches 0% is determined depending on whether or not a flag indicating the removal of the partially used toner bottle is stored in association with the information of the toner bottle stored in the storage unit 402 in step S704.

If it is determined that the toner bottle has been removed before the remaining toner amount reaches 0%, the process proceeds to step S903, and if it is determined that the toner bottle has not been removed before the remaining toner amount reaches 0%, the process proceeds to step S907. In step S903, the management information transmission unit 401 generates data (alarm transmission data) for transmitting the alarm informing that the partially used tonner bottle has been removed. In the alarm transmission data generated here, an alarm code indicating that an event related to the replacement of the toner bottle has been generated is set as the alarm code 607.

In step S904, the management information transmission unit 401 sets an alarm subcode indicating that the alarm informing that the tonner bottle is being removed as the alarm subcode 608 in the alarm transmission data. Note that the color information of the toner of the partially used toner bottle that has been removed is set to the alarm subcode 608 of the alarm transmission data.

In step S905, the management information transmission unit 401 acquires identification information of the partially used toner bottle that has been removed, and the remaining partially used toner amount when the partially used toner bottle is removed, which have been stored from the storage unit 402 in step S705, and are set to the extended information 609 of the alarm transmission data. Additionally, the management information transmitting unit 401 acquires the total counter value at the present time from the storage unit 402 and sets the value to the counter value 610 of the alarm transmission data. Subsequently, the management information transmission unit 401 transmits the alarm transmission data generated as an alarm informing about the removal of the partially used toner bottle to the management server 106.

In step S907, the management information transmission unit 401 generates data (alarm transmission data) for transmitting an alarm informing about the mounting of a new toner bottle. In the alarm transmission data generated here, an alarm code indicating that an event related to the replacement of the toner bottle has been generated is set as the alarm code 607.

In step S908, the management information transmission unit 401 sets an alarm subcode indicating that the alarm informs about the mounting of a new toner bottle as the alarm subcode 608 to the alarm transmission data. Note that as the alarm subcode 608 of the alarm transmission data, the color information of the toner of the mounted toner bottle is also set.

In step S909, the management information transmission unit 401 acquires the identification information of the currently mounted toner bottle and the initial value of the remaining toner amount, which have been stored in step S708 or S709, from the storage unit 402, and sets them to the extended information 609 of the alarm transmission data. Additionally, the management information transmitting unit 401 acquires the total counter value at the current moment from the storage unit 402 and sets the value to the counter value 610 of the alarm transmission data. Then, the management information transmission unit 401 transmits the alarm transmission data generated as an alarm informing about the mounting of a new toner bottle to the management server 106.

Figure 10:
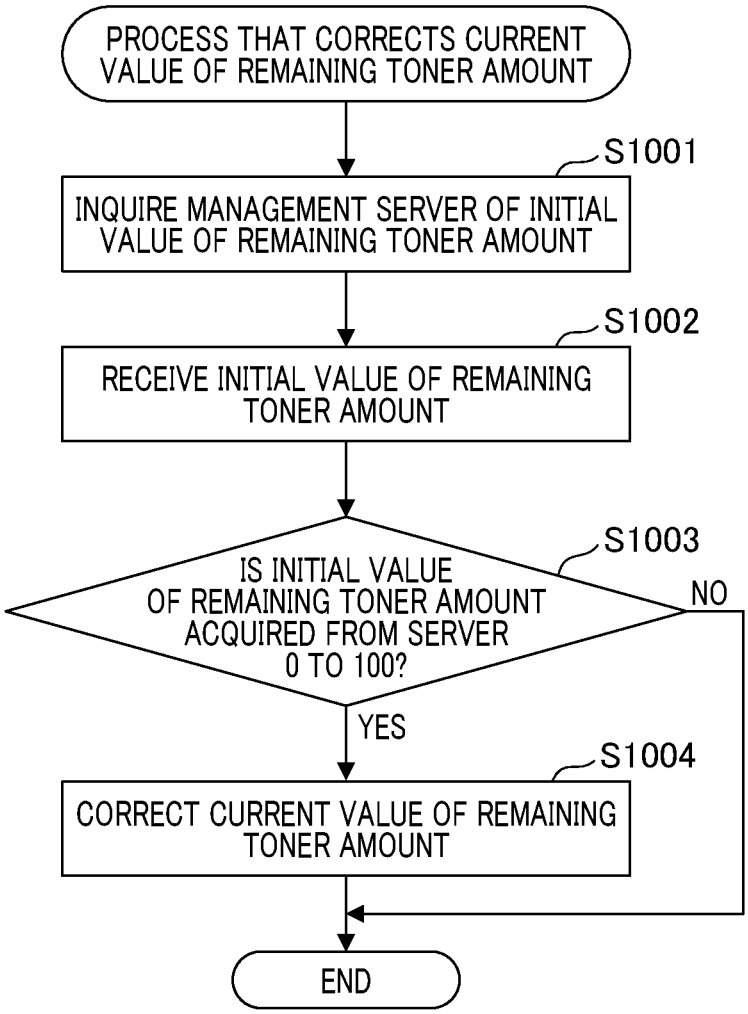
FIG. 10 illustrates a process of correcting a current value of the remaining toner amount.

FIG. 10 is a flowchart that explains the details of the process that corrects the current value of the remaining toner amount in the process of initializing a remaining toner amount (S814) (FIG. 8). Note that the process that corrects the current value of the remaining toner amount may be executed not only in step S814, but also may be executed if the toner bottle has a memory tag and the remaining toner amount information of the toner bottle cannot be read from the memory tag.

For example, the process may be executed if the remaining toner amount prediction unit 412 cannot read the information about remaining toner amount from the memory tag of the toner bottle even after a fixed period of time has elapsed after displaying a message urging the user to remount the toner bottle in the display unit 406 in step S809. In this case, the value of the remaining toner amount to be corrected is the current value of the remaining toner amount that has been initialized in step S808 or S811.

In step S1001, the remaining toner amount prediction unit 412 inquires the management server 106 of the remaining toner amount of the toner bottle that has been mounted in step S706. Specifically, the remaining toner amount prediction unit 412 inquires the management server 106 about the initial value of the remaining toner amount of the toner bottle having the identification information by using the identification information of the mounted toner bottle stored in the storage unit 402 in step S708 or S709. Hereinafter, this inquiry is referred to as a "request for acquiring remaining toner amount initial value".

In step S1002, the remaining toner amount prediction unit 412 acquires the remaining toner amount managed by the management server 106 as the initial value of the remaining toner amount from the management server 106. The remaining toner amount when the partially used toner bottle is mounted and is removed is stored and managed in the management server 106, in a case where the toner bottle has been mounted in any one of the printing apparatuses 102 in the past as shown in FIG. 9. Since these values are associated by the identification information of the toner bottle, these values can be acquired as the initial value of the remaining toner amount. Note that the operation of the management server 106 upon receipt of the request for acquiring remaining toner amount initial value will be described below with reference to FIG. 15.

In step S1003, the remaining toner amount prediction unit 412 determines whether or not the initial value of the acquired remaining toner amount is within the range of 0 to 100(%). If it is determined that the initial value of the acquired remaining toner amount is within the range of 0 to 100(%), the process proceeds to step S1004, and if it is determined that it is outside the range of 0 to 100(%), the process ends.

In step S1004, the remaining toner amount prediction unit 412 corrects the current value of the remaining toner amount managed by the storage unit 402, which has been initialized in step S813, with the initial value of the remaining toner amount acquired from the management server 106.

Specifically, the current value of the remaining toner amount is corrected by using the following formula.

Remaining toner amount current value after correction=remaining toner amount current value before correction−(100−initial value of remaining toner amount acquired from the management server)

Accordingly, a print job is executed after initializing the current value of the remaining toner amount in step S813, and the correction to the current value of the remaining toner amount using the accurate initial value of the remaining toner amount is possible even if the current value has been updated. As described above, even if a temporarily used toner bottle, that is, a toner bottle having a remaining toner amount of less than 100%, is mounted in the other one of the printing apparatuses 102, the remaining tonner amount can be initialized by using the initial value of the accurate remaining toner amount.

Figure 15:
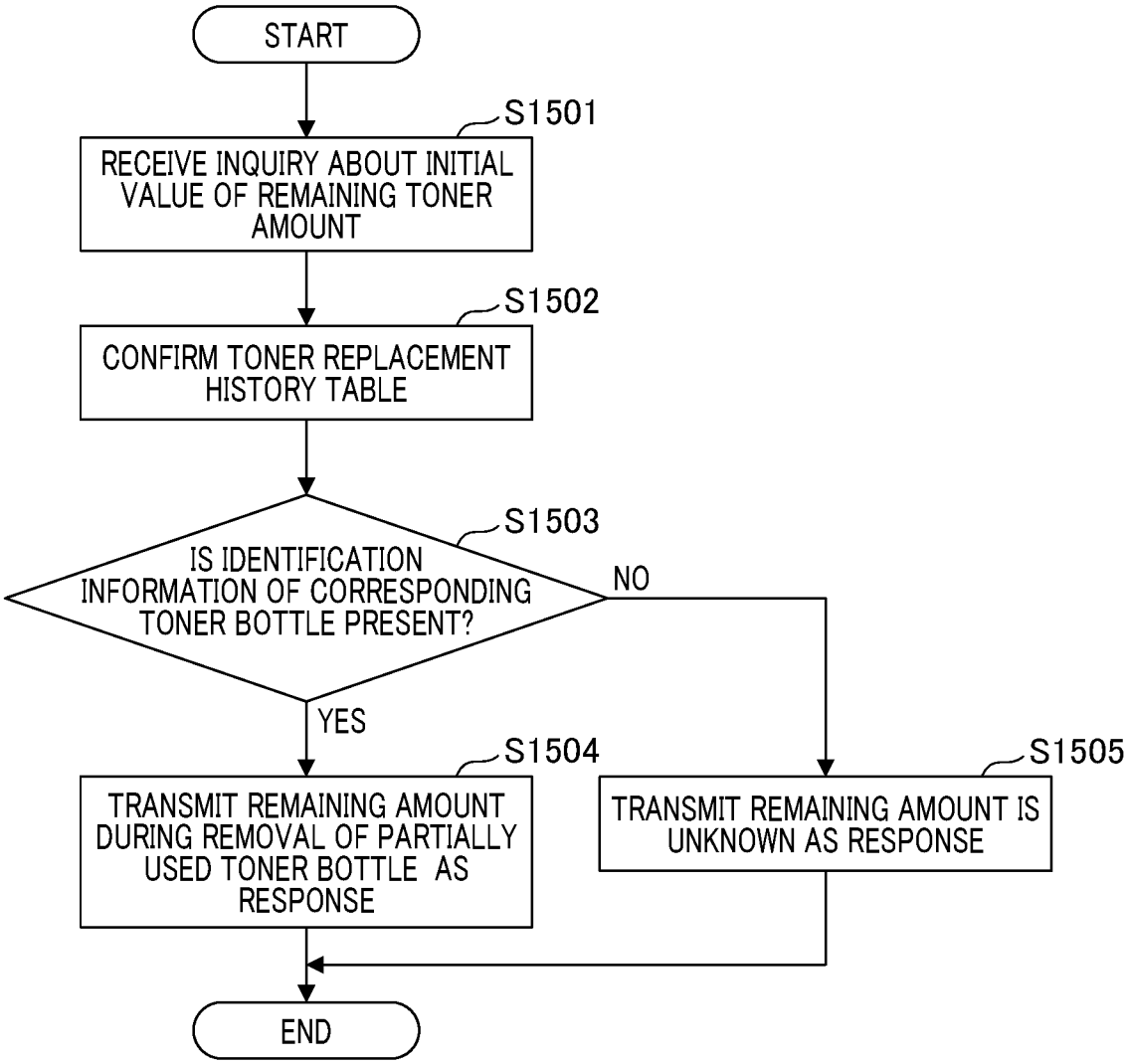
FIG. 15 illustrates an operation if a request for acquiring an initial value of the remaining toner amount has received.

FIG. 15 is a flowchart that explains the operation upon receipt of a request for acquiring the initial value of the remaining toner amount from the printing apparatuses 102 by the management server 106 (S1001). In step S1501, the event information receiving unit 511 of the management server 106 receives a request for acquiring the initial value of the remaining toner amount from the printing apparatuses 102. In step S1502, the event information receiving unit 511 confirms a toner bottle replacement history table managed by the device information management unit 509.

FIGS. 11A and 11B illustrate an example of a toner bottle replacement history table. The toner bottle replacement history table is a table in which the management server 106 manages a replacement status of the toner bottle at the customer. If the event information receiving unit 511 of the management server 106 receives event information indicating that an event related to the replacement of the toner bottle delivered to the customer has been generated, the event information receiving unit 511 acquires various information from the event information.

Subsequently, the event information receiving unit 511 stores the various acquired information in the toner bottle replacement history table. The event information related to the replacement of the toner bottle includes the alarm informing about the mounting of a new toner bottle and the alarm informing about the removal of the partially used toner bottle described above. Specifically, in the toner bottle replacement history table, the remaining toner amount upon the mounting of a new toner bottle or upon the removal of the partially used toner bottle before the bottle becomes empty, is managed in the printing apparatuses 102.

In other words, the toner bottle replacement history table is data in which the use history of the consumables at the customer is recorded. The toner bottle replacement history table includes a device identifier, an alarm reception date and time, a toner replacement date and time, a toner bottle ID, a toner bottle type, a remaining amount, a replacement notice type, a counter, and a real use counter.

The device identifier is identification information of the printing apparatuses 102 in which the event related to the toner bottle has been generated, where a value acquired from the serial number 603 of the event information received from the printing apparatuses 102 by the event information receiving section 511 is stored. In the alarm reception date and time, the date and time when the event information has been received by the event information receiving section 511 from the printing apparatuses 102 is stored.

The toner replacement date and time is date and time when an event, in particular, the removal of a partially used toner bottle or the mounting of a new toner bottle has been generated in the printing apparatuses 102, and the value acquired by the event information receiving unit 511 from the generated time 606 of the received event information is stored. The toner bottle ID is identification information of the partially used toner bottle that has been removed or has been newly mounted in the printing apparatuses 102, in which the value acquired by the event information receiving unit 511 from the extended information 609 of the received event information is stored.

The remaining amount is information indicating a remaining toner amount in the toner bottle upon the generation of the removal of the partially used toner bottle or the mounting of a new toner bottle in the printing apparatuses 102. As the remaining amount, the value acquired by the event information receiving unit 511 from the extended information 609 of the received event information is stored.

If the received event information is the alarm informing about the mounting of a new toner bottle, this remaining amount is the initial value of the remaining tonner amount stored in the storage unit 402 in steps S804, S807, S810, or S812 of the initialization process of the remaining toner amount (FIG. 8). Additionally, if the received event is the alarm informing about the removal of the partially used tonner bottle, the remaining amount is the remaining amount of the partially used tonner that has been removed, which has been stored in the storage unit 402, upon the generation of the removal of the partially used tonner bottle.

The replacement notice type is a type of an event related to the replacement of the toner bottle generated in the printing apparatuses 102, and in the present embodiment, it is information indicating the alarm informing about the removal of the partially used toner bottle or the alarm informing about the mounting of a new toner bottle. In the replacement notice type, the event information receiving unit 511 stores either one of "the detection of a new bottle" or "the removal of the partially used bottle" based on alarm subcode 608 of the received event information.

In the counter, the value acquired by the event information receiving unit 511 from the counter value 610 of the received event information is stored. This counter value is a counter value of the printing apparatuses 102 at the time when the toner bottle has been mounted and starts to be used if the received event information is the alarm informing about the mounting of a new toner bottle. Additionally, if the received event information is the alarm informing about the removal of the partially used toner bottle, the counter is a counter value of the printing apparatuses 102 at the moment when the removal of the partially used toner bottle has been generated.

The actual use counter is a counter value involving one toner bottle, that is, a counter value from the mounting of a target tonner bottle to the printing apparatuses 102 to the removal of the tonner bottle therefrom. The event information receiving unit 511 calculates a difference between a value acquired from the counter value 610 included in the alarm informing about the mounting of a new toner bottle and a value acquired from the counter value 610 included in the alarm informing about the mounting of a new toner bottle that has been received last time from the same one of the printing apparatuses 102. That is, the difference between the counter value at the start of using the newly mounted toner bottle and the counter value at the start of using the toner bottle that has previously been mounted is stored as the value of the actual use counter.

The process returns to the description in FIG. 15. In step S1503, the event information receiving unit 511 determines whether or not the identification information of the toner bottle included in the received request for acquiring a remaining toner amount is present in the toner bottle replacement history table. If the identification information of the toner bottle included in the acquisition request is present in the toner bottle replacement history table, the process proceeds to step S1504, and if not, the process proceeds to step S1505.

In step S1504, the event information receiving unit 511 acquires the remaining amount information corresponding to the identification information of the toner bottle from the toner bottle replacement history table. Then, the event information receiving unit 511 generates response data including the identification information and the acquired remaining amount information via the response generation unit 505, and responds to the printing apparatuses 102. The fact that the identification information of the toner bottle is present in the toner bottle replacement history table means that the toner bottle has been mounted in the other one of the printing apparatuses 102 in the past and the partially used tonner bottle has been removed before the remaining toner amount becomes empty.

The remaining toner amount information acquired here is a remaining toner amount if the partially used tonner bottle has been removed from the printing apparatuses 102. In contrast, in step S1505, the event information receiving unit 511 generates response data including the identification information and information indicating that the remaining amount is unknown via the response generation unit 505, and responds to the printing apparatuses 102.

Next, with reference to FIG. 12, a process performed if the management server 106 receives event information about replacement of the toner bottle from the printing apparatuses 102 will be described. In step S1201, the event information receiving unit 511 receives event information from the printing apparatuses 102. In step S1202, the event information receiving unit 511 stores the received event information in an event information history (not illustrated) managed by the device information management unit 509.

In step S1203, the event information receiving unit 511 determines whether or not the received event information is the alarm informing about the mounting of a new toner bottle. If the event information receiving unit 511 determines that the received event information is the alarm informing about the mounting of a new tonner bottle, the process proceeds to step S1204. If the event information receiving unit 511 determines that the received event information is not the alarm informing about the mounting of a new toner bottle, the process proceeds to step S1211.

In step S1211, the event information receiving unit 511 determines whether or not the received event information is the alarm informing about the removal of the partially used toner bottle. If the event information receiving unit 511 determines that the received event information is the alarm informing about the removal of the partially used toner bottle, the process proceeds to step S1212. If the event information receiving unit 511 determines that the received event information is not the alarm informing about the removal of the partially used toner bottle, the process ends.

In step S1212, the event information receiving unit 511 adds one piece of historical data to the toner bottle replacement history table and updates the value of each item of the history data by using the alarm information 605 included in the received alarm.

In step S1204, the event information receiving unit 511 adds one piece of history data to the toner bottle replacement history table, and updates the value of each item of the history data by using the alarm information 605 included in the received alarm. In step S1205, the event information receiving unit 511 determines whether or not the value of the remaining amount acquired from the alarm and stored in the toner bottle replacement history table is within the range of 0 to 100(%).

Note that the value of the remaining amount is an initial value of the remaining toner amount acquired from the extended information 609 of the received event information, and as described in FIGS. 11A and 11B, the value of the remaining amount is the remaining toner amount acquired when mounting a new toner bottle. If the value of the remaining amount is within the range of 0 to 100(%), the process proceeds to step S1209, and if it is out of the range of 0 to 100(%), the process proceeds to step S1206.

In step S1206, the event information receiving unit 511 determines whether or not the value of the remaining amount acquired from the received event information and stored in the toner bottle replacement history table is a value indicating that the memory tag is in failure. If it is determined that the value of the remaining amount is a value indicating that the memory tag has failed, the process proceeds to step S1207, and if the value of the remaining amount does not indicate that the memory tag has not failed, in other words, the remaining amount is unknown, the process proceeds to step S1208.

In step S1207, the event information receiving unit 511 performs a preliminary delivery process of delivering the toner bottle to the customer. Note that the preliminary delivery process will be described below with reference to FIG. 14. In step S1208, the event information receiving unit 511 performs a process of supplementing remaining amount information. Note that the details of the process of supplementing the remaining amount information will be described below with reference to FIG. 13.

In step S1209, the event information receiving unit 511 inquires the consumable inventory management 515 to determine whether or not the toner bottle is set as the target for the inventory control at the customer of the printing apparatuses 102 that is the transmission source of the event information that has been received this time. If the event information receiving unit 511 determines that the toner bottle has not been set as the target for the inventory control, the process ends, and if the event information receiving unit 511 has determined that the toner bottle is set as the target for the inventory control, the process proceeds to step S1210.

In step S1210, the consumable inventory management 515 updates the inventory information of the corresponding customer. Specifically, one of the printing apparatuses 102 in which the event has been generated and the type of the toner bottle mounted this time are specified based on the device identification information 601 and the alarm subcode 608 included in the received event information, and "1" is subtracted from the estimated inventory number managed by the consumable inventory management 515.

Figure 12:
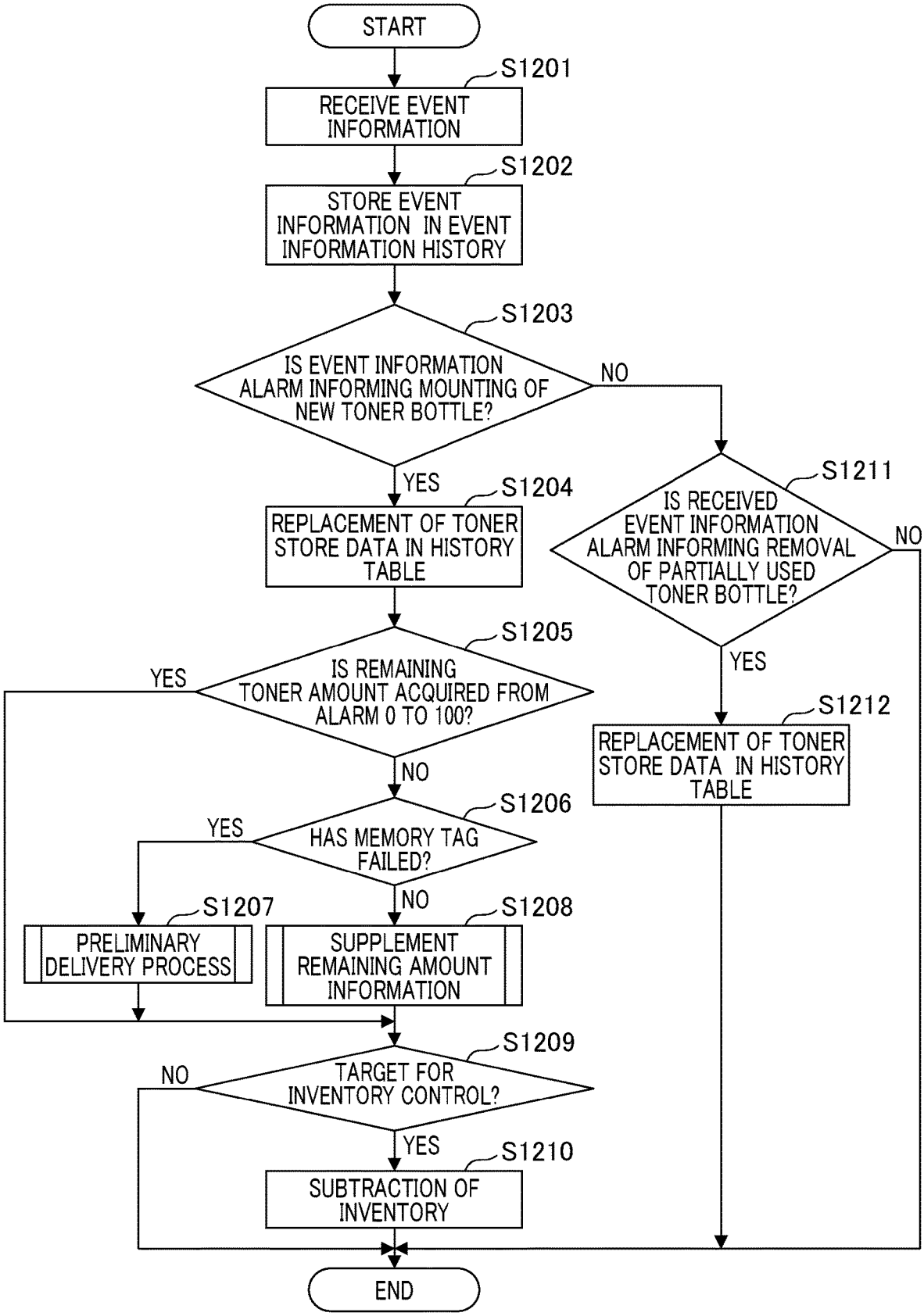
FIG. 12 illustrates a process if event information is received.
Figure 13:
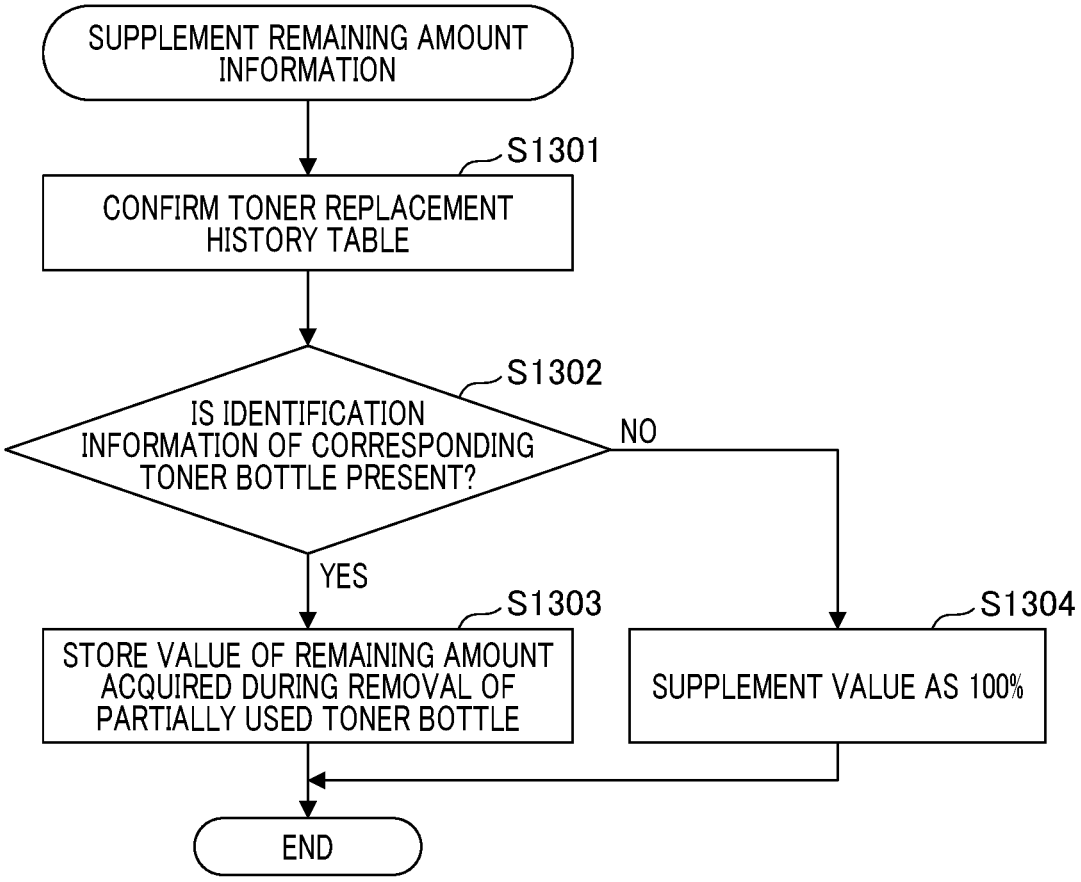
FIG. 13 illustrates a process that supplements remaining amount information.

FIG. 13 is a flowchart that explains the details of the process (S1208) that supplements the remaining amount information in the process performed if the management server 106 receives the event information about the replacement of the toner bottle from the printing apparatuses 102 (FIG. 12). In step S1301, the event information receiving unit 511 confirms the toner bottle replacement history table (FIGS. 11A and 11B).

In step S1302, the event information receiving unit 511 determines whether or not the identification information of the toner bottle included in the alarm informing about the mounting of a new toner bottle, which is the event information received in step S1201, is present in the toner bottle replacement history table. Specifically, the event information receiving unit 511 determines whether or not history data having the identification information is present in the toner bottle replacement history table, in addition to the new history data to be corrected in the present process, which has been added in step S1204 in accordance with the received event information.

This means that the partially used toner bottle is used by the other one of the printing apparatuses 102 in the past and has been removed, in a case where history data having the identification information of the toner bottle included in the received event information is present. If the partially used tonner bottle has been removed, the remaining toner amount at the removal is acquired.

If it is determined that the identification information of the toner bottle is present in the toner bottle replacement history table, the process proceeds to step S1303, and if it is determined that the identification information is not present in the toner bottle replacement history table, the process proceeds to step S1304. In step S1303, the event information receiving unit 511 overwrites and updates the value of the remaining amount of the history data added in step S1204 with the remaining amount of the toner at the removal of the partially used tonner bottle in the past acquired in step S1302.

In step S1304, the value of the remaining amount of the history data added in step S1204 is updated as 100%. This is because the identification information of the toner bottle included in the event information is not present in the toner bottle replacement history table in step S1302, and as a result, it is determined that the partially used tonner bottle has not been removed in the other one of the printing apparatuses 102 in the past, or in other words, it is unused.

As described above, if the information indicates the remaining amount information of the toner acquired from the alarm informing about the mounting of a new toner bottle, in this case, if the information indicates that the initial value of the remaining toner amount cannot be acquired by the printing apparatuses 102, the management server 106 supplements the value based on the toner bottle replacement history. Specifically, it is determined whether or not a toner bottle having the identification information of the same toner bottle has been used in the other one of the printing apparatuses 102 in the past. Subsequently, if there is no history data, in other words, if the corresponding toner bottle has not been used in the past, the remaining amount is set to 100%, and if the history data is present, the value is updated with the remaining toner amount at the removal of the partially used tonner bottle.

Accordingly, even if the management server 106 cannot acquire the initial value of the remaining toner amount from the alarm informing about the mounting of a new toner bottle received from the printing apparatuses 102, that is, the management server 106 cannot acquire the remaining amount at the start of using the newly mounted toner bottle, the value is supplemented. Then, a service person and the like of the selling company can grasp the correct initial value of the remaining toner amount based on the past usage history of the toner bottle at the portal site and the like provided by the management server 106.

FIG. 11A illustrates the toner bottle replacement history table immediately after adding history data in step S1204 if the event information receiving unit 511 receives the alarm informing about the mounting of a new toner bottle. FIG. 11B illustrates the toner bottle replacement history table after performing the process of supplementing the remaining amount information shown in FIG. 13, in contrast to FIG. 11A.

In FIG. 11A, since the remaining toner amount information included in the alarm informing about the mounting of a new toner bottle received from the printing apparatuses 102 having the device identifier of "device B" has not been able to be acquired by the printing apparatuses 102, the remaining amount is stored as it is, as "unknown". In contrast, in FIG. 11B, it is found that the remaining amount is updated to "70" in accordance with the past usage history of the corresponding toner bottle by the supplementing process of the remaining amount information.

Specifically, the identification information of the toner bottle that has not been able to be acquired from the alarm informing about the mounting of a new toner bottle this time is "TN 04-006885". If the past use history of the toner bottle having this identification information is confirmed, it is found that the removal of the partially used tonner bottle is performed based on the device A, in which the remaining amount of the toner at the removal of the partially used tonner bottle is "70". Accordingly, the remaining amount is updated from "unknown" to "70".

Figure 14:
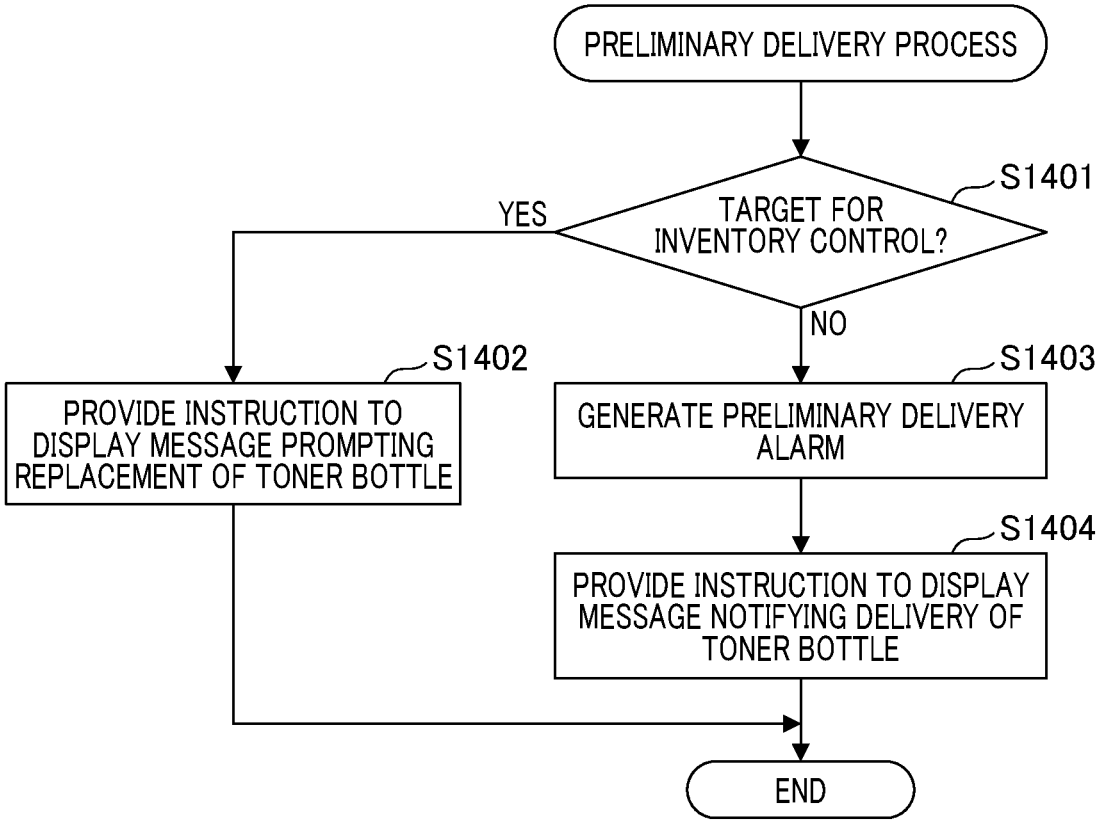
FIG. 14 illustrates a preliminary delivery process that delivers a toner bottle to a customer.

FIG. 14 is a flowchart that illustrates the details of the preliminary delivery process (S1207) of delivering the toner bottle to the customer in the process (FIG. 12) performed if the management server 106 has received the event information related to the replacement of the toner bottle from the printing apparatuses 102. In detail, the preliminary delivery process is executed if the management server 106 determines that there is a failure in the memory tag of the toner bottle mounted by the user.

In step S1401, the event information receiving unit 511 accesses the consumable inventory management 515 to determine whether or not the toner bottle is set as the target for inventory control at the customer of the printing apparatuses 102 that is the transmission source of the event information that has been received this time. This is the same as determining whether or not the customer who uses the printing apparatuses 102 that is the transmission source of the event information received this time holds the inventory of the toner bottle.

Specifically, this is because, if the toner bottle is set as the target for inventory control at the customer of the printing apparatuses 102, the inventory of the toner bottle does not become insufficient at the customer, and the toner bottle is delivered before the inventory becomes insufficient. In other words, if the toner bottle is set as the target for the inventory control at the customer of the printing apparatuses 102, the customer holds the inventory, so that it is only required to display a message urging the customer to replace the tonner bottle.

In contrast, if the toner bottle is not set as the target for inventory control at the customer of the printing apparatuses 102, it is contemplated that the inventory of the toner bottle is not held at the customer. That is, since there may be cases in which there are no toner bottles for replacement, the delivery of the toner bottle is arranged and the user is notified that the toner bottle has been delivered. If it is determined that the toner bottle is set as the target for the inventory control, the process proceeds to step S1402, and if it is determined that the toner bottle is not set as the target for inventory control, the process proceeds to step S1403.

In step S1402, the event information receiving unit 511 instructs the printing apparatuses 102, which is the transmission source of the alarm informing about the mounting of a new toner bottle, to display a message urging the customer to replace the toner bottle via the message management unit 513. Note that in the printing apparatuses 102, a process that displays the message in which the display is instructed from the management server 106 will be described below with reference to FIGS. 18 and 19.

Figure 17A:
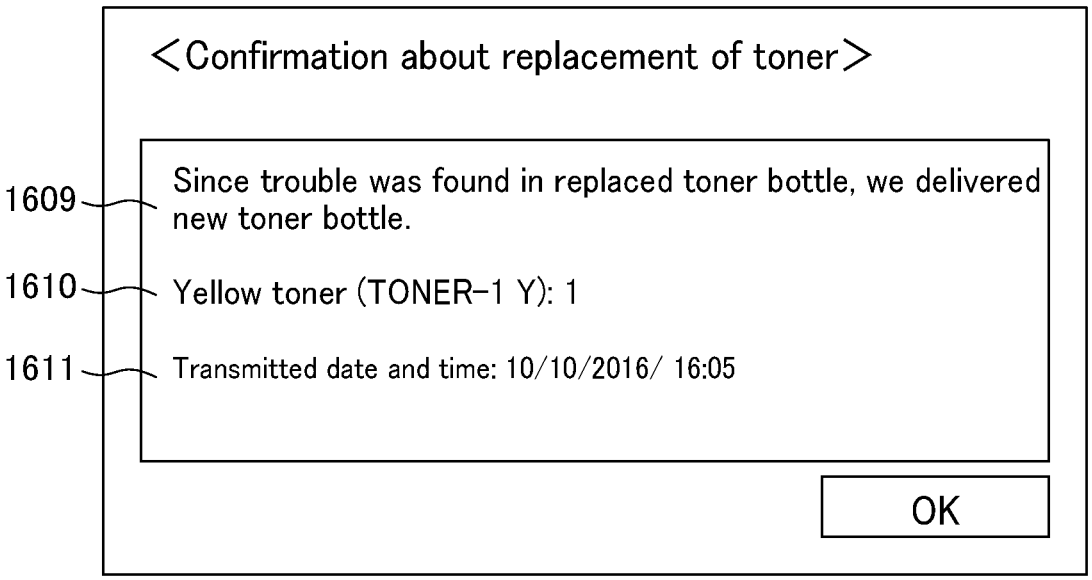
FIGS. 17A and 17B illustrate an example of the UI screen displayed on the input/output device of the printing apparatus.
Figure 17B:
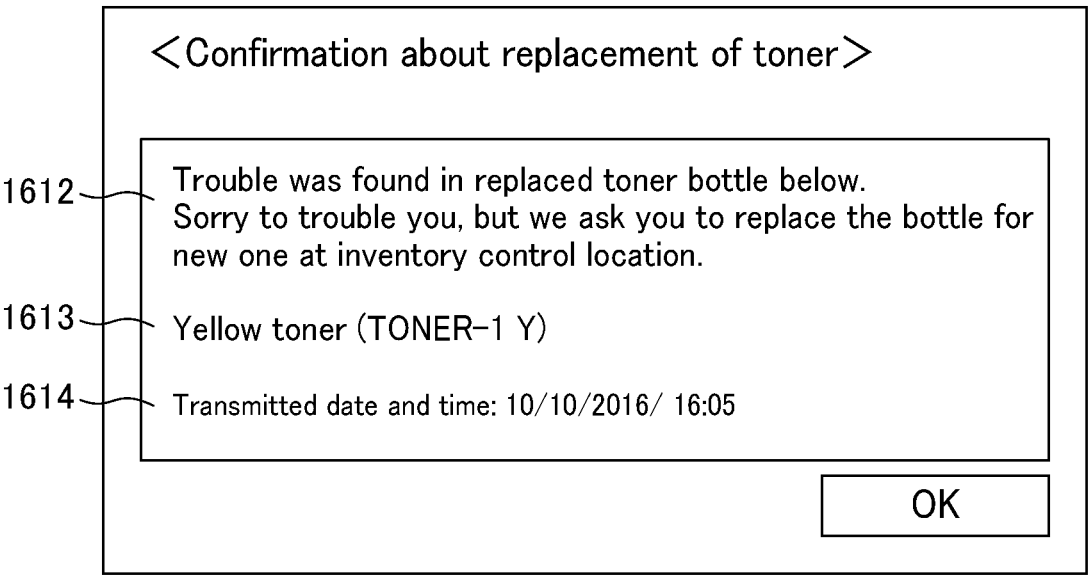

FIG. 17B is an example of a message urging the customer to replace the toner bottle, which is displayed on the display unit 406 of the printing apparatuses 102. A message 1612 is a message urging the customer to replace the toner bottle. A toner bottle type 1613 is a type of the toner bottle that needs to be replaced. A transmission date and time 1614 is date and time when the message has been transmitted from the management server 106. Note that the message shown in FIG. 17B is an example, and the present invention is not limited to this.

The process returns to the description in FIG. 14. In step S1403, the event information receiving unit 511 instructs the pseudo alarm generating unit 514 to generate an alarm in a pseudo manner. The pseudo alarm generated here generates in pseudo manner an alarm (advance delivery alarm) notifying the management server 106 of the generation of event indicating that the remaining toner amount has reached a predetermined amount or less (toner low) by the printing apparatuses 102.

The generated alarm is referred to as a "preliminary delivery alarm". The management server 106 that has received the advance delivery alarm arranges automatic delivery of the toner bottle corresponding to the contents of the alarm to the delivery system 109. In step S1403, the management server 106 requests automatic delivery of the toner bottle to the delivery system 109 by the advance delivery alarm that substitutes for the preliminary delivery alarm that has been generated in a pseudo manner.

In step S1404, the event information receiving unit 511 provides an instruction to display a message notifying about the delivery of the toner bottle to the printing apparatuses 102, which is the transmission source of the alarm informing about the mounting of a new toner bottle and serves as the delivery target of a new toner bottle, via the message management unit 513. Note that the process that displays a message in which the display is instructed from the management server 106 in the printing apparatuses 102 will be described below with reference to FIGS. 18 and 19.

FIG. 17A is an example of a message notifying about the delivery of the toner bottle to be displayed on the display unit 406 of the printing apparatuses 102. A message 1609 is a message providing notification that a toner bottle to be replaced has been delivered. A toner bottle type 1610 is a type of the delivered toner bottle. A transmission date and time 1611 is date and time when the message has been transmitted from the management server 106. Note that the message shown in FIG. 17A is an example, and the present invention is not limited to this.

The explanation will return to the description in FIG. 14. The message generated by the message management unit 513 in steps S1402 and S1404 is generated as an HTML file and registered in the message management table as shown in FIG. 20A. The message management table includes items such as generation date/time when the message was generated, identification information of the printing apparatuses 102 to which the message is to be transmitted, and title and contents of the message.

Additionally, the message management table includes items such as a display start date at which the display of the message starts and a display end date at which the display ends in the printing apparatuses 102. Moreover, the message management table includes items such as icon display setting indicating whether or not to display an icon that provides notification that the message is present on the UI screen displayed on the input/output device 210 of the printing apparatuses 102. Additionally, the message management table includes items such as a status indicating whether or not the message has been displayed in the printing apparatuses 102.

Additionally, the message management unit 513 registers an instruction to display a new message in the display instruction management table as shown in FIG. 20B. The display instruction management table is generated for each of the printing apparatuses 102 and includes items such as the device identifier, which is the identification information of the printing apparatuses 102, the generation date and time of the message, and an instruction status indicating whether or not the message has been transmitted to the printing apparatuses 102 to which the message is to be displayed.

"Not transmitted" is stored as the instruction status at the time when the message display instruction is registered. Note that the message management table shown in FIG. 20A and the display instruction management table shown in FIG. 20B are mere examples, and the present invention is not limited to this, and other items may be included.

Figure 18:
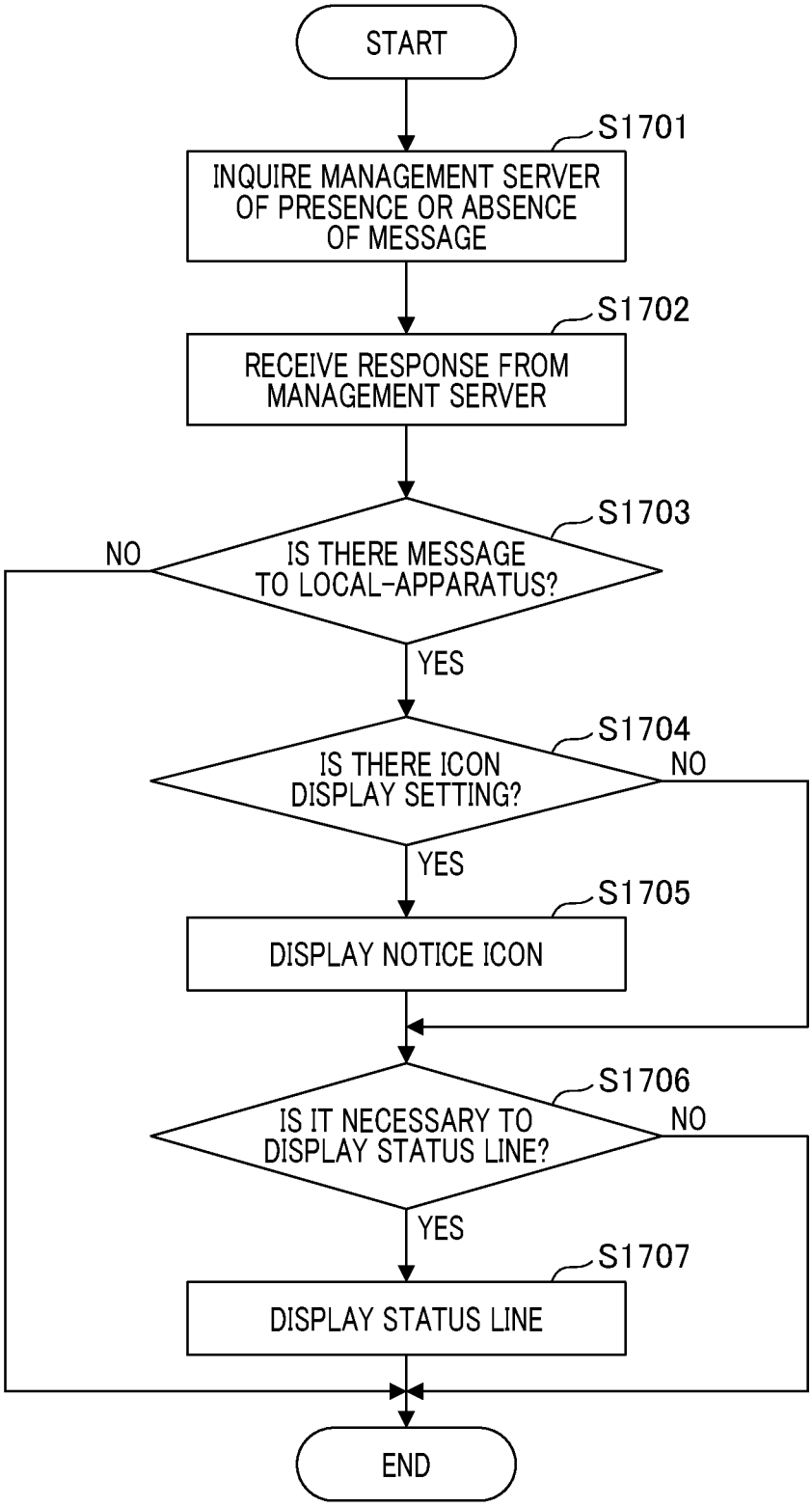
FIG. 18 illustrates a process that acquires a message.

FIG. 18 is a flowchart that explains a process in which the printing apparatuses 102 acquires a message generated by the management server 106. In step S1701, the device information control unit 404 of the printing apparatuses 102 inquires the management server 106 about whether or not an instruction to display a message to the local apparatus is present. The device information control unit 404 inquires the management server 106 about this inquiry at regular intervals.

Upon receipt of the inquiry from the printing apparatuses 102, the message management unit 513 of the management server 106 confirms whether or not the display instruction to the printing apparatuses 102 is present in the display instruction management table (FIG. 20B) and that the instruction status is "not transmitted". If the instruction to display a message to the printing apparatuses 102 is present and the instruction status is "not transmitted", the message management unit 513 of the management server 106 transmits an instruction to display the corresponding message serving as a response to the inquiry.

Note that in the instruction to display a message, data including the subject and transmission date and time of the corresponding message is transmitted from the message management table (FIG. 20A) serving as data for displaying a message list, which will be described below with reference to FIG. 16B. However, the present invention is not limited to this, and for example, the instruction to display a message may include all contents of the message.

Note that if the instruction to display a message to the printing apparatuses 102 is not present or if the instruction status is not "not transmitted", the message management unit 513 transmits the information indicating that the inquiry has been normally received as a response to the inquiry. In step S1702, the device information control unit 404 of the printing apparatuses 102 receives a response to the inquiry from the management server 106. In step S1703, the device information control unit 404 determines whether or not the received response is an instruction to display a message.

If the received response is an instruction to display a message, the process proceeds to step S1704, and if it is not an instruction to display a message, the process ends. In step S1704, the device information control unit 404 determines whether or not the icon display setting is included in the display setting of the received message.

If it is determined that the icon display setting is included, the process proceeds to step S1705, and if it is determined that the icon display setting is not included, the process proceeds to step S1706. In step S1705, the device information control unit 404 displays an icon that notifies the UI screen displayed on the input/output device 210 of the printing apparatuses 102 via the icon display control unit 415 of the presence of a message from the management server 106.

Figure 16A:
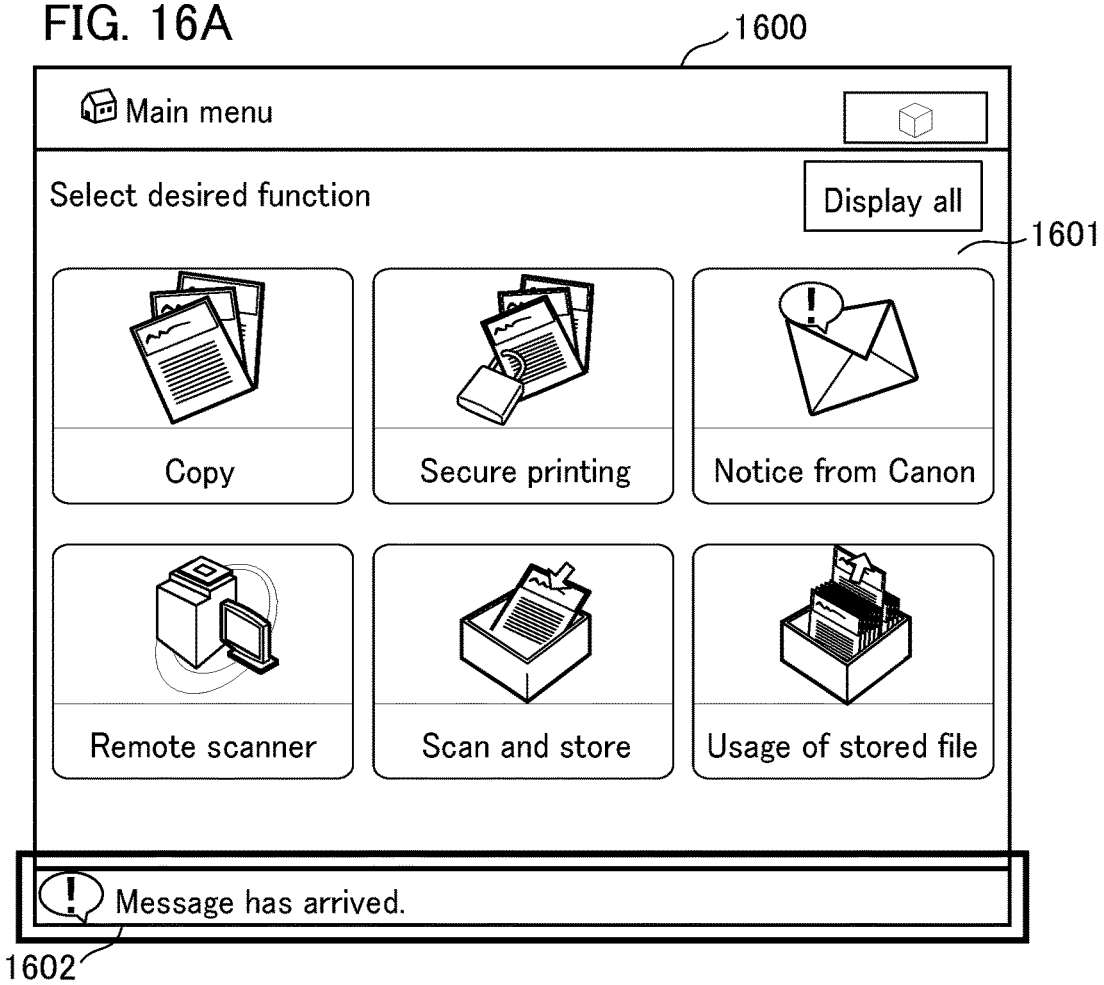
FIGS. 16A and 16B illustrate an example of a UI screen displayed on an input/output device of the printing apparatus.

FIG. 16A is an example of a UI screen that provides notification that the message from the management server 106 is present. In a UI screen 1600, if the message is transmitted from the management server 106 and the icon display setting is included in the message, an icon 1601 is displayed.

The process will return to the description in FIG. 18. In step S1706, the device information control unit 404 determines whether or not it is necessary to display the presence of a message from the management server 106 on the status line. Specifically, the device information control unit 404 compares the reception time of the message included in the response received in step S1702 with the acquired time of the previous message held by the storage unit 402.

Subsequently, if the reception time of the message included in the response is newer (later) than the time when the previous message was acquired, the device information control unit 404 determines that the message needs to be displayed on the status line. If it is determined that the message needs to be displayed on the status line, the process proceeds to step S1707, and if it is determined that the message does not need to be displayed on the status line, the process ends.

In step S1707, the device information control unit 404 displays that a new message has been received on the status line via the status line display control unit 414. The status line display control unit 414, for example, reports the reception of the message as shown by the status line 1602 shown in FIG. 16A.

Figure 19:
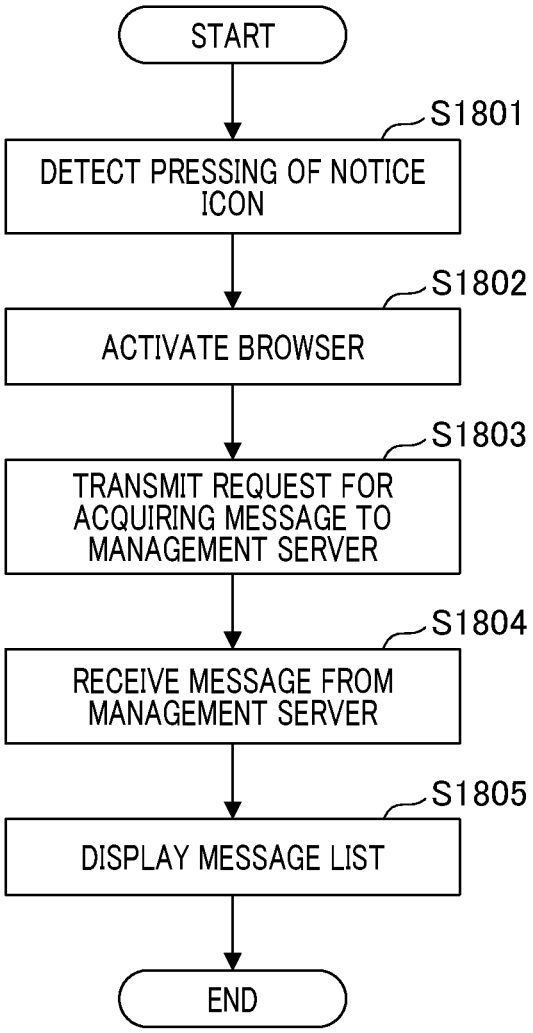
FIG. 19 illustrates a process that displays a message.

FIG. 19 is a flowchart that explains a process of displaying a message by the printing apparatuses 102. In step S1801, the message display control unit 413 detects that the user has pressed the icon 1601 (notice icon) displayed on the UI screen of the input/output device 210.

In step S1802, the message display control unit 413 activates a browser function. In step S1803, the message display control unit 413 requests the management server 106 to acquire a message to be displayed on the browser. In step S1804, the message display control unit 413 receives data including a message to be displayed in which the display instruction has been received from the management server 106.

In step S1805, the message display control unit 413 displays the message list on the input/output device 210 by using the browser function based on the received data. The message list is a list of messages in which the display message has been received from the management server 106.

Figure 16B:
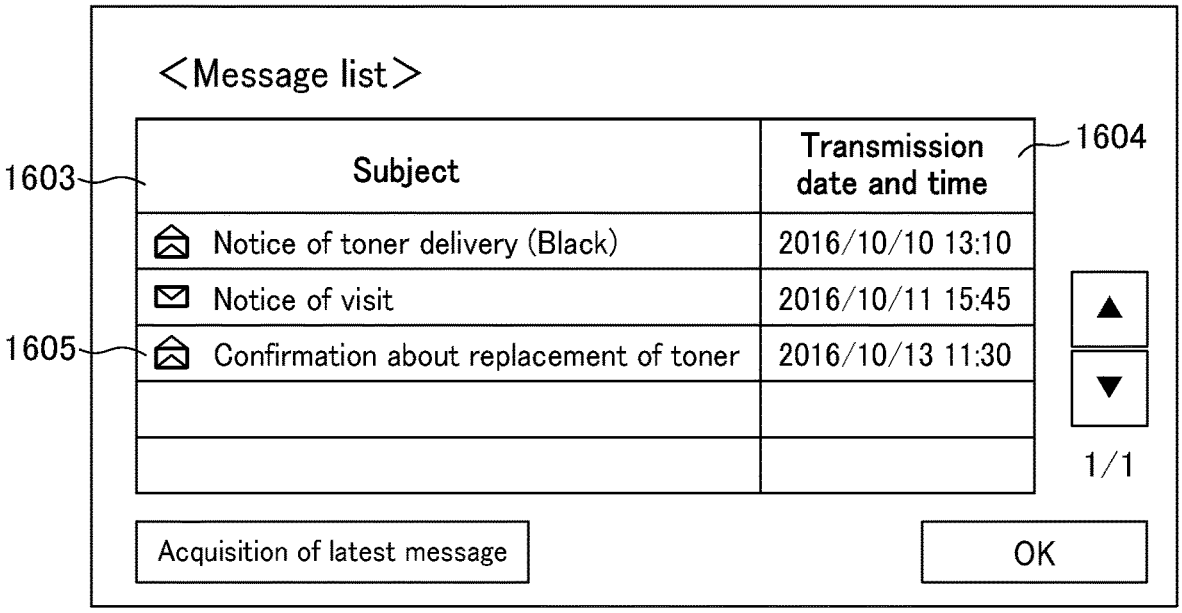

FIG. 16B illustrates an example of a message list to be displayed by pressing the "notice icon" 1601. In the message list, a subject 1603 and the transmission date and time 1604 of the message in which the display instruction has been transmitted from the management server 106 to the printing apparatuses 102 are displayed.

If the user selects a specific message, for example, a message 1605 having the subject of "confirmation about replacement of toner", the message display control unit 413 requests the management server 106 to acquire the detailed contents of the message. When receiving data including the message to be displayed, the message display control unit 413 displays the contents of the message as shown in FIG. 17A and FIG. 17D based on the received data, as described above.

As described above, according to the present embodiment, the management server 106 receives event information indicating that the mounting of a new toner bottle or the removal of the partially used toner bottle has been performed from the printing apparatuses 102. Subsequently, the management server 106 manages the identification information of the toner bottle included in the event information and the remaining toner amount at the time when the event has been generated as a usage history.

Subsequently, if the memory tag of the toner bottle mounted in the printing apparatuses 102 has failed, it is possible to generate a preliminary delivery alarm and provide an instruction to deliver the toner bottle to be replaced. Additionally, if the memory tag of the toner bottle mounted in the printing apparatuses 102 has not failed but information cannot be read from the memory tag, it is possible to supplement the initial value of the remaining tonner amount of the tonner bottle, based on the usage history managed by the management server.

Note that, in the present embodiment, a toner bottle has been described as an example of the consumables, but the present invention is not limited to this. For example, the present invention can also be applied to a case in which a remaining amount of the recording agent contained in each consumable is managed, in a manner similar to other consumable items such as a toner cartridge, an ink tank, an ink bottle, and ink cartridges and the like. Additionally, in the present embodiment, the image forming apparatus has been described as an example of the printing apparatus, but the present invention is not limited to this. For example, the present invention can also be applied to a device that forms a three-dimensional object by using a recording agent using a molding material and the like, which is referred to as a "3D printer".

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-185482, filed Sep. 26, 2017, which is hereby incorporated by reference wherein in its entirety.

What is claimed is:

1. A managing system comprising:

a memory storing instructions; and a processor that is capable of executing the instructions stored in the memory causing the managing system to:

receive an alarm pertaining to a consumable mounted on a printing apparatus; and generate a pseudo alarm for the printing apparatus if the received alarm is an alarm indicating the detection of a failure pertaining to a storage device provided in the consumable, wherein the pseudo alarm provides an instruction to deliver a new consumable for the printing apparatus.

2. The managing system according to claim 1, wherein the pseudo alarm is generated if the received alarm is the alarm indicating the detection of the failure pertaining to the storage device provided in the consumable and a customer who uses the printing apparatus does not maintain an inventory.

3. The management system according to claim 2, wherein the pseudo alarm is not generated if the received alarm is an alarm indicating the detection of the failure pertaining to the storage device provided in the consumable and a customer who uses the printing apparatus maintains an inventory.

4. The management system according to claim 1, wherein the instructions further cause the management system to manage, if the received alarm is an alarm indicating a detection of mounting of the consumable to the printing apparatus, identification information of the consumable included in the alarm and a remaining amount of a recording agent contained in the consumable, by using a storage for the management system.

5. The management system according to claim 4, wherein the instructions further cause the management system to manage, if the received alarm is an alarm indicating a detection of removal of the consumable from the printing apparatus, the remaining amount of the recording agent when removing the consumable by using the storage.

6. The management system according to claim 5, wherein the instructions further cause the management system to supplement the remaining amount of the recording agent when mounting the consumable, by using the remaining amount of the recording agent stored in the storage, if the remaining amount of the recording agent when mounting the consumable is unknown and the remaining amount of the recording agent at the removal of the consumable before the recording agent of the consumable becomes empty is stored in the storage in association with the identification information of the consumable.

7. The management system according to claim 4, wherein the instructions further cause the management system to supplement the remaining amount of the recording agent when mounting the consumable, by using a value indicating that the consumable is unused, if the remaining amount of the recording agent when mounting the consumable is unknown and the remaining amount of the recording agent of the consumable is not stored in the storage in association with the identification information of the consumable.

8. The management system according to claim 4, wherein the instructions further cause the management system to respond the remaining amount of the recording agent of the consumable managed in the storage, in response to an inquiry about the remaining amount of the recording agent of the consumable, if the consumable is not provided with the storage device.

9. The management system according to claim 1, wherein the consumable is any one of a toner bottle, a toner cartridge, an ink tank, an ink bottle, and an ink cartridge.

10. The management system according to claim 1, wherein the printing apparatus is an apparatus that forms an image by using a recording agent on a sheet, or an apparatus that forms a three-dimensional object by using a recording agent.

11. A method for controlling a management system, the system comprising:

receiving an alarm pertaining to a consumable mounted on a printing apparatus; and generating a pseudo alarm for the printing apparatus if the received alarm is an alarm indicating the detection of a failure pertaining to a storage device provided in the consumable, wherein the pseudo alarm provides an instruction to deliver a new consumable for the printing apparatus.

* * * * *